US011745064B2

(12) United States Patent
Morales et al.

(10) Patent No.: US 11,745,064 B2
(45) **Date of Patent: *Sep. 5, 2023**

(54) IRON-TYPE GOLF CLUB HEAD WITH FLEX STRUCTURE

(71) Applicant: KARSTEN MANUFACTURING CORPORATION, Phoenix, AZ (US)

(72) Inventors: Eric J. Morales, Laveen, AZ (US); Jeremy S. Pope, Kansas City, MO (US); Thomas J. Nuttall, Aylesbury (GB)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/689,742

(22) Filed: Mar. 8, 2022

(65) Prior Publication Data

US 2022/0184465 A1 Jun. 16, 2022

Related U.S. Application Data

(63) Continuation of application No. 16/600,228, filed on Oct. 11, 2019, now Pat. No. 11,298,596.

(Continued)

(51) Int. Cl.
*A63B 53/04* (2015.01)

(52) U.S. Cl.
CPC ..... *A63B 53/047* (2013.01); *A63B 53/0408* (2020.08); *A63B 53/0454* (2020.08); *A63B 53/0462* (2020.08)

(58) Field of Classification Search
CPC ..... A63B 53/0454; A63B 53/047; A63B 2053/0495; A63B 53/08; A63B 53/0458; A63B 53/04

(Continued)

(56) References Cited

U.S. PATENT DOCUMENTS 550,976 A * 12/1895 Jennings ..... A63B 53/047 473/329
1,154,490 A * 9/1915 Davis ..... A63B 53/047 473/329

(Continued)

FOREIGN PATENT DOCUMENTS

FR 2635688 3/1990
FR 2635688 A1 * 3/1990

(Continued)

*Primary Examiner* — Alvin A Hunter

(57) ABSTRACT

Embodiments of an iron type golf club head with a flex structure, a face reinforcing structure, and a variable face thickness to increase face element bending while improving club head durability are described herein. The club head comprises a face element for striking a golf ball. The face element is formed integrally with the flex structure. The flex structure comprises a curved profile (e.g. S-shape or sinusoidal) that functions like a spring to support the face element during golf ball impacts. The face reinforcing structure comprises a looped rib that provides support around a center of the face element. The variable face thickness includes thickened and thinned regions to provide further face element bending or support. The combination of the flex structure, the face reinforcing structure, and the variable face thickness provides increased face element bending while improving club head durability.

18 Claims, 11 Drawing Sheets

Related U.S. Application Data

(60) Provisional application No. 62/821,962, filed on Mar. 21, 2019, provisional application No. 62/745,176, filed on Oct. 12, 2018.

(58) Field of Classification Search
USPC ..... 473/324–350
See application file for complete search history.

(56) References Cited

U.S. PATENT DOCUMENTS 1,359,220 A 11/1920 Beamer
3,589,731 A * 6/1971 Chancellor, Jr. ..... A63B 53/08 473/333
4,511,145 A * 4/1985 Schmidt ..... A63B 53/0466 473/346
4,836,550 A 6/1989 Kobayashi
5,282,625 A * 2/1994 Schmidt ..... A63B 60/00 473/350
5,344,140 A * 9/1994 Anderson ..... A63B 60/00 473/342
5,409,229 A 4/1995 Schmidt et al.
5,472,203 A * 12/1995 Schmidt ..... A63B 53/04 473/350
5,505,453 A * 4/1996 Mack ..... A63B 53/0466 473/329
5,586,947 A 12/1996 Hutin
5,595,552 A 1/1997 Wright et al.
5,643,099 A 7/1997 Solheim
5,649,872 A 7/1997 Antonious
5,695,411 A 12/1997 Wright et al.
5,873,791 A 2/1999 Allen
5,873,795 A * 2/1999 Wozny ..... A63B 53/04 473/346
6,210,290 B1 4/2001 Erickson et al.
6,309,311 B1 * 10/2001 Lu ..... A63B 60/00 473/340
6,319,149 B1 11/2001 Lee
6,354,956 B1 * 3/2002 Doong ..... A63B 53/0466 473/328
6,406,382 B1 * 6/2002 Deshmukh ..... A63B 53/0487 473/336
6,616,546 B2 9/2003 Cho
6,652,391 B1 * 11/2003 Kubica ..... A63B 53/02 473/345
6,800,038 B2 * 10/2004 Willett ..... A63B 53/04 473/345
6,849,005 B2 2/2005 Rife
6,855,069 B2 2/2005 Nagai et al.
6,872,153 B2 * 3/2005 Gilbert ..... A63B 60/02 473/332
6,904,663 B2 * 6/2005 Willett ..... A63B 53/0466 29/557
6,964,620 B2 11/2005 Gilbert et al.
6,966,848 B2 * 11/2005 Kusumoto ..... A63B 60/00 473/345
6,989,506 B2 * 1/2006 Yabu ..... B23K 26/24 219/121.64
6,991,559 B2 * 1/2006 Yabu ..... A63B 53/04 473/409
6,997,820 B2 * 2/2006 Willett ..... A63B 60/00 473/349
7,018,305 B2 * 3/2006 Sugimoto ..... A63B 53/04 473/345
7,056,229 B2 * 6/2006 Chen ..... A63B 53/0466 473/346
7,066,832 B2 * 6/2006 Willett ..... A63B 53/04 473/345
RE39,178 E 7/2006 Allen
7,083,530 B2 8/2006 Wahl et al.
7,137,903 B2 11/2006 Best et al.
7,144,337 B2 * 12/2006 Hirano ..... A63B 53/047 473/329
7,192,362 B2 * 3/2007 Gilbert ..... A63B 53/00 473/332
7,192,363 B2 * 3/2007 Blankenship ..... A63B 53/08 473/332
7,192,364 B2 3/2007 Long
7,238,119 B2 7/2007 Roach et al.
7,261,642 B2 * 8/2007 Blankenship ..... A63B 53/08 473/409
7,294,064 B2 * 11/2007 Tsurumaki ..... A63B 53/0466 473/345
7,387,579 B2 6/2008 Lin et al.
7,476,162 B2 * 1/2009 Stites ..... A63B 60/00 473/332
7,544,136 B2 * 6/2009 Tsai ..... A63B 53/047 473/349
7,575,524 B2 * 8/2009 Willett ..... A63B 53/047 473/345
7,771,291 B1 * 8/2010 Willett ..... A63B 53/0466 473/345
7,789,771 B2 9/2010 Park et al.
7,988,567 B2 * 8/2011 Kim ..... A63B 53/04 473/329
8,210,961 B2 * 7/2012 Finn ..... A63B 53/0466 473/345
8,262,495 B2 9/2012 Stites
8,272,975 B2 * 9/2012 Morin ..... A63B 60/00 473/342
8,353,785 B2 * 1/2013 Ines ..... A63B 60/00 473/342
8,535,177 B1 * 9/2013 Wahl ..... A63B 53/04 D21/748
8,608,585 B2 * 12/2013 Stites ..... A63B 53/047 473/282
8,647,218 B2 * 2/2014 Gilbert ..... A63B 60/54 473/346
8,690,710 B2 4/2014 Nicolette et al.
8,758,163 B2 6/2014 Stites
8,801,541 B2 * 8/2014 Beach ..... A63B 60/10 473/282
8,821,313 B1 9/2014 Dawson et al.
8,894,507 B2 11/2014 Boyd et al.
8,911,301 B1 * 12/2014 Allen ..... A63B 60/52 473/332
9,044,653 B2 * 6/2015 Wahl ..... A63B 53/0475
9,199,138 B2 12/2015 Willett et al.
9,259,629 B2 2/2016 Gilbert et al.
9,387,370 B2 7/2016 Hebreo et al.
9,421,436 B2 * 8/2016 Soracco ..... A63B 60/02
9,446,293 B2 * 9/2016 Lee ..... A63B 53/0466
9,457,241 B2 * 10/2016 Hebreo ..... A63B 53/0487
9,480,888 B1 * 11/2016 Allen ..... A63B 60/54
9,561,412 B2 * 2/2017 Ueda ..... A63B 53/047
9,586,104 B2 3/2017 Roach
9,675,852 B2 6/2017 Westrum
D801,460 S * 10/2017 Milleman ..... D21/748
9,937,395 B2 * 4/2018 Taylor ..... A63B 60/00
10,004,955 B2 6/2018 Henrikson et al.
10,065,088 B2 * 9/2018 Hebreo ..... A63B 53/047
10,086,244 B2 10/2018 Morin et al.
10,150,019 B2 * 12/2018 Ines ..... A63B 60/00
10,150,020 B2 12/2018 Cole et al.
10,258,843 B2 * 4/2019 Morales ..... A63B 60/54
10,293,226 B2 * 5/2019 Hebreo ..... A63B 53/08
10,300,352 B2 5/2019 Daraskavich et al.
10,343,037 B2 * 7/2019 Hebreo ..... A63B 53/0466
10,363,466 B2 7/2019 Petersen et al.
10,413,789 B1 * 9/2019 Seluga ..... A63B 60/00
D863,479 S * 10/2019 Stokke ..... D21/747
10,427,018 B2 10/2019 Taylor et al.
10,493,336 B2 12/2019 Taylor et al.
10,500,449 B2 * 12/2019 Henrikson ..... A63B 53/0466
10,512,826 B1 * 12/2019 Frederickson ..... A63B 53/06
10,543,409 B2 * 1/2020 Demkowski ..... A63B 60/52
10,625,127 B2 * 4/2020 Golden ..... A63B 53/06
10,661,136 B2 * 5/2020 Onuki ..... A63B 60/50
10,751,587 B2 * 8/2020 Clarke ..... A63B 60/00
10,905,926 B2 * 2/2021 Morales ..... A63B 60/00
10,918,919 B2 * 2/2021 Morales ..... A63B 60/00

(56) References Cited

U.S. PATENT DOCUMENTS

| | | | | |
|---|---|---|---|---|
| 11,298,596 | B2 * | 4/2022 | Morales | A63B 53/047 |
| 2002/0183134 | A1 | 12/2002 | Allen et al. | |
| 2003/0190975 | A1 * | 10/2003 | Fagot | A63B 53/047 473/346 |
| 2004/0083596 | A1 * | 5/2004 | Willett | A63B 53/0466 473/331 |
| 2004/0099538 | A1 * | 5/2004 | Chao | B23H 9/00 205/705 |
| 2005/0239570 | A1 * | 10/2005 | Best | A63B 53/047 473/292 |
| 2006/0116219 | A1 * | 6/2006 | Hirano | A63B 53/047 473/350 |
| 2007/0015601 | A1 | 1/2007 | Tsunoda et al. | |
| 2009/0017934 | A1 | 1/2009 | Stites et al. | |
| 2009/0029796 | A1 | 1/2009 | Mergy et al. | |
| 2010/0273565 | A1 * | 10/2010 | Stites | A63B 53/047 473/282 |
| 2012/0283036 | A1 | 11/2012 | Stites et al. | |
| 2013/0165257 | A1 | 6/2013 | Dipert et al. | |
| 2013/0225316 | A1 * | 8/2013 | Cole | A63B 60/00 473/340 |
| 2015/0165280 | A1 * | 6/2015 | Hebreo | A63B 60/00 473/342 |
| 2015/0328506 | A1 | 11/2015 | Morales et al. | |
| 2017/0361177 | A1 * | 12/2017 | Hebreo | A63B 53/047 |
| 2018/0056146 | A1 | 3/2018 | Franz et al. | |
| 2018/0133565 | A1 | 5/2018 | Hebreo et al. | |
| 2018/0147457 | A1 | 5/2018 | Bacon et al. | |
| 2018/0339204 | A1 * | 11/2018 | Hebreo | A63B 53/047 |
| 2020/0114221 | A1 * | 4/2020 | Morales | A63B 53/04 |
| 2020/0368591 | A1 * | 11/2020 | Hebreo | A63B 53/0475 |

FOREIGN PATENT DOCUMENTS

| | | | | | |
|---|---|---|---|---|---|
| GB | 2280380 | | | 2/1995 | |
| JP | 11042302 | | | 2/1992 | |
| JP | 05269224 | | | 10/1993 | |
| JP | 05269224 | A | * | 10/1993 | |
| JP | 09024125 | | | 1/1997 | |
| JP | 09024125 | A | * | 1/1997 | |
| JP | 11042302 | A | * | 2/1999 | |
| JP | 11128412 | | | 5/1999 | |
| JP | 11128412 | A | * | 5/1999 | |
| JP | 2000237363 | | | 9/2000 | |
| JP | 2000237363 | A | * | 9/2000 | |
| JP | 2002204841 | | | 7/2002 | |
| JP | 2002204841 | A | * | 7/2002 | |
| JP | 2005110852 | | | 4/2005 | |
| JP | 2005110852 | A | * | 4/2005 | A63B 53/04 |
| JP | 2016174887 | | | 10/2016 | |
| JP | 2016174887 | A | * | 10/2016 | |
| JP | 2019084325 | | | 6/2019 | |
| JP | 2019084325 | A | * | 6/2019 | |
| KR | 20050116556 | A | * | 12/2005 | |
| TW | I238076 | | | 8/2005 | |
| WO | WO-9920358 | A1 | * | 4/1999 | A61K 31/00 |

* cited by examiner

IRON-TYPE GOLF CLUB HEAD WITH FLEX STRUCTURE

CROSS REFERENCE TO RELATED APPLICATIONS

This is a continuation of U.S. Nonprovisional application Ser. No. 16/600,228, filed Oct. 11, 2019, which claims the benefit of U.S. Provisional Application No. 62/821,962, filed Mar. 21, 2019, and U.S. Provisional Application No. 62/745,176, filed Oct. 12, 2018, wherein the contents of all above-described disclosures are incorporated herein by reference in their entirety.

FIELD OF THE INVENTION

This invention generally relates to iron-type club heads with structures that reinforce the face element.

BACKGROUND

Various characteristics of a golf club can affect the performance of the golf club. For example, the center of gravity, the moment of inertia, and the coefficient of restitution of the club head of the golf club are each characteristics of a golf club that can affect performance.

The center of gravity and moment of inertia of the club head of the golf club are functions of the distribution of mass of the club head. In particular, distributing mass of the club head to be closer to a sole of the club head, farther from a face of the club head, and/or closer to toe and heel ends of the club head can alter the center of gravity and/or the moment of inertia of the club head. For example, distributing mass of the club head to be closer to the sole of the club head and/or farther from the face of the club head can increase a flight angle of a golf ball struck with the club head. Meanwhile, increasing the flight angle of a golf ball can increase the distance the golf ball travels. Further, distributing mass of the club head to be closer to the toe and/or heel ends of the club head can affect the moment of inertia of the club head, which can alter the forgiveness of the golf club.

Further, the coefficient of restitution of the club head of the golf club can be a function of at least the flexibility of the face of the club head. Meanwhile, the flexibility of the face of the club head can be a function of the geometry (e.g., height, width, and/or thickness) of the face and/or the material properties (e.g., Young's modulus) of the face. That is, maximizing the height and/or width of the face, and/or minimizing the thickness and/or Young's modulus of the face, can increase the flexibility of the face, thereby increasing the coefficient of restitution of the club head; and increasing the coefficient of restitution of the club head of the golf club, which is essentially a measure of the efficiency of energy transfer from the club head to a golf ball, can increase the distance the golf ball travels after impact, decrease the spin of the golf ball, and/or increase the ball speed of the golf ball.

However, although thinning the face of the club head can permit mass from the face to be redistributed to other parts of the club head and can make the face more flexible, thinning the face of the club head also can result in increased bending in the face to the point of buckling and failure. Accordingly, there is a need in the art for a club head that increases face bending while maintaining or improving the durability of the face.

Figure 1:
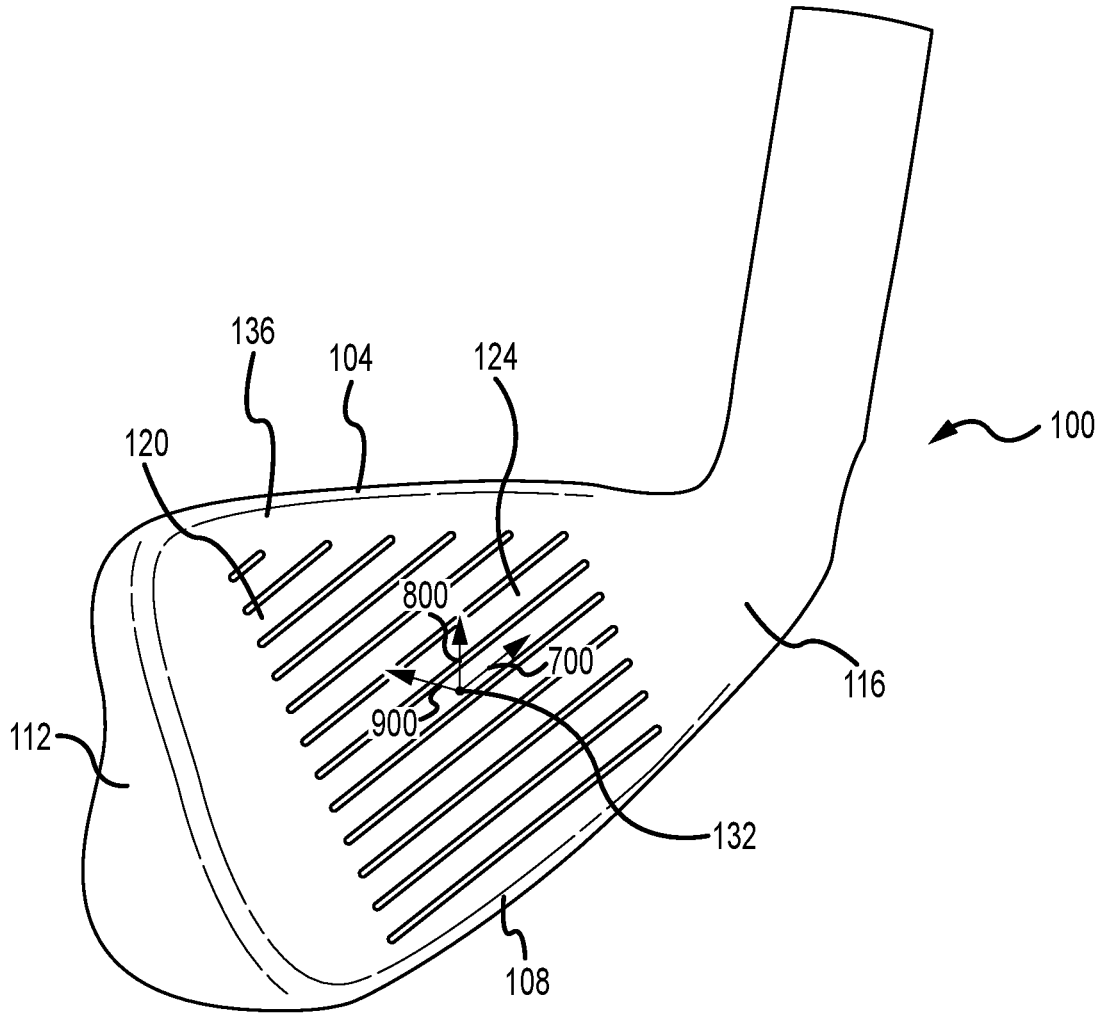
FIG. 1 illustrates a front perspective view of an iron-type club head according to an embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The present embodiments discussed below are directed to iron-type club heads having structures that support the face element. The club head comprises a face element for striking a golf ball. The face element is formed integrally with a flex structure. The flex structure comprises a curved profile (e.g., S-shape or sinusoidal) that bends or flexes like a spring to support the face element during golf ball impacts. To withstand the stresses that occur when the face element bends, the club head further comprises a face reinforcing structure and a variable face element thickness. The face reinforcing structure is formed integrally with the face element and the flex structure to provide support to the face element. The face reinforcing structure comprises a looped rib that provides support near a geometric center of the face element. The face reinforcing structure allows the face element to include strategically placed thickened and thinned regions. In one example, the face element is thinned at the geometric center within the face reinforcing structure, thickened in locations around the geometric center, and thickened in locations outside the face reinforcing structure near a heel end or a toe end of the club head. The combination of the flex structure, the face reinforcing structure, and the variable face element thickness allows for increased face element bending, increased ball speed, and the movement of large stresses away from the face element and into the face reinforcing structure during golf ball impacts. The movement of large stresses into the face reinforcing structure improves club head durability. The iron-type club head including the flex structure, the face reinforcing structure, and the variable face element thickness further allows for an overall thinner face element compared to face elements devoid of the flex structure and/or the face reinforcing structure. The club head having the combination of the flex structure, the face reinforcing structure, and the variable face element thickness allows for an internal energy increase of 3.7 lbf-in compared to club heads devoid of the flex structure, the face reinforcing structure, and the variable face element thickness. An internal energy increase of 3.7 lbf-in equates to approximately a 0.5 mph increase in ball speed and approximately a 4 to 7 yard increase in distance.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "loft" or "loft angle" of a golf club, as described herein, refers to the angle formed between the club face and the shaft, as measured by any suitable loft and lie machine.

Embodiments of a golf club head are described herein, wherein the golf club head can comprise an iron-type club head. More specifically, the iron-type club head can be a muscle-back iron-type club head, a cavity-back iron-type club head, a blade style iron-type club head, hollow body iron-type club head, a cavity-muscle back iron-type club head, high-MOI iron-type club head, or any other type of iron-type club head. The iron-type club head comprises a loft angle. The loft angle refers to the angle formed between a club face and a shaft. More specifically, the loft angle is measured from a vertical plane extending from a hosel/shaft centerline axis to a club face. The loft angle is measured rearward in a direction from the vertical plane to the club face of the iron-type club head.

For example, in some embodiments, the iron-type club head can have a loft angle less than approximately 60 degrees, less than approximately 59 degrees, less than approximately 58 degrees, less than approximately 57 degrees, less than approximately 57 degrees, less than approximately 56 degrees, less than approximately 55 degrees, less than approximately 54 degrees, less than approximately 53 degrees, less than approximately 52 degrees, less than approximately 51 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, less than approximately 25 degrees, less than approximately 24 degrees, less than approximately 23 degrees, less than approximately 22 degrees, less than approximately 21 degrees, less than approximately 20 degrees, less than approximately 19 degrees or less than approximately 18 degrees.

Further, in some embodiments, the loft angle of the iron-type club head is greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees, greater than approximately 27 degrees, greater than approximately 28 degrees, greater than approximately 29 degrees, greater than approximately 30 degrees, greater than approximately 31 degrees, greater than approximately 32 degrees, greater than approximately 33 degrees, greater than approximately 34 degrees, greater than approximately 35 degrees, greater than approximately 36 degrees, greater than approximately 37 degrees, greater than approximately 38 degrees, greater than approximately 39 degrees, greater than approximately 40 degrees, greater than approximately 41 degrees, greater than approximately 42 degrees, greater than approximately 43 degrees, greater than approximately 44 degrees, greater than approximately 45 degrees, greater than approximately 46 degrees, greater than approximately 47 degrees, greater than approximately 48 degrees, greater than approximately 49 degrees, greater than approximately 50 degrees, greater than approximately 51 degrees, greater than approximately 52 degrees, greater than approximately 53 degrees, greater than approximately 54 degrees, greater than approximately 55 degrees, greater than approximately 56 degrees, greater than approximately 57 degrees, greater than approximately 58 degrees, greater than approximately 59 degrees, or greater than approximately 60 degrees.

Further, in some embodiments, the loft angle of the iron-type club head can be 60 degrees, 59 degrees, 58 degrees, 57 degrees, 56 degrees, 55 degrees, 54 degrees, 53 degrees, 52 degrees, 51 degrees, 50 degrees, 49 degrees, 48 degrees, 47 degrees, 46 degrees, 45 degrees, 46 degrees, 45 degrees, 44 degrees, 43 degrees, 42 degrees, 41 degrees, 40 degrees, 39 degrees, 38 degrees, 37 degrees, 36 degrees, 35 degrees, 34 degrees, 33 degrees, 32 degrees, 31 degrees, 30 degrees, 29 degrees, 28 degrees, 27 degrees, 26 degrees, 25 degrees, 24 degrees, 23 degrees, 22 degrees, 21 degrees, 20 degrees, 19 degrees, 18 degrees, or 17 degrees.

For further example, in some embodiments, the loft angle of the iron-type club head can range from 17 degrees to 60 degrees. In other embodiments, the loft angle of the club head can range from 17 degrees to 40 degrees, or 40 degrees to 60 degrees. In other embodiments, the loft angle of the club head can range from 17 degrees to 35 degrees, 25 degrees to 40 degrees, 30 degrees to 45 degrees, 35 degrees to 50 degrees, 40 degrees to 55 degrees, or 45 degrees to 60 degrees. In other embodiments, the loft angle of the club head can range from 17 degrees to 30 degrees, 30 degrees to 40 degrees, 40 degrees to 50 degrees, or 50 degrees to 60 degrees.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Iron-Type Club Head with Flex Structure

The present technology generally relates to an iron-type club head having increased face element bending while improving club head durability. These advantages can be achieved with a club head having one integral body that includes a flex structure, a face reinforcing structure, and a variable face element thickness. The flex structure is formed integrally with the face reinforcing structure and a rear portion of the club head. The flex structure comprises a curved shape (e.g., S-shape or sinusoidal) that extends between the face element and the rear portion. The flex structure does not contact the club head except for the connections at the face reinforcing structure and the rear portion. This allows the flex structure to freely bend without interference with the structure of the club head. The flex structure provides support to the face element to allow for an overall thinner face element compared to face elements devoid of the flex structure and/or face reinforcing structure.

The face reinforcing structure includes a closed looped rib that is formed integrally with face element. The face reinforcing structure extends around a geometric center of the face element. The face reinforcing element provides localized thickness thereby making the face element stiffer or more rigid at locations around the geometric center of the face element. The face reinforcing structure further includes a fillet that provides a smooth transition between the face element and the face reinforcing structure. The closed looped rib and the fillet direct large stresses away from the face element and into the face reinforcing structure thereby improving the durability of the face element and the club head.

The variable face element thickness includes strategically placed thickened and thinned regions. The thickened regions provide support to the face element while the thinned regions increase face element bending. In one example, the face element can comprise a minimum thickness at the geometric center, and a maximum thickness along the face reinforcing structure. The face element can further include one or more thickness regions located away from the face reinforcing structure near the toe end and heel end of the club head. The one or more thickness regions provide additional support for golf ball impacts near the heel and toe regions of the club head. The combination of the flex structure, the face reinforcing structure, and the variable face element thickness formed integrally in one club head body provides increased face element bending and ball speed while improving club head durability. The club head having the combination of the flex structure, the face reinforcing structure, and the variable face element thickness allows for an internal energy increase of 3.7 lbf-in compared to club heads devoid of the flex structure, the face reinforcing structure, and the variable face element thickness. An internal energy increase of 3.7 lbf-in equates to approximately a 0.5 mph increase in ball speed and approximately a 4 to 7 yard increase in distance. Described below is a first embodiment of the present technology and performance examples that demonstrate the advantages of the invention.

Referring to the drawings, wherein like reference numerals are used to identify like or identical components in various views, FIGS. 1-6 schematically illustrate a first embodiment of the present design. Specifically, FIG. 1 illustrates a front perspective view of an iron-type club head 100. The club head 100 includes a top rail 104, a sole 108 opposite the top rail 104, a toe end 112, and a heel end 116 opposite the toe end 112.

Figure 2:
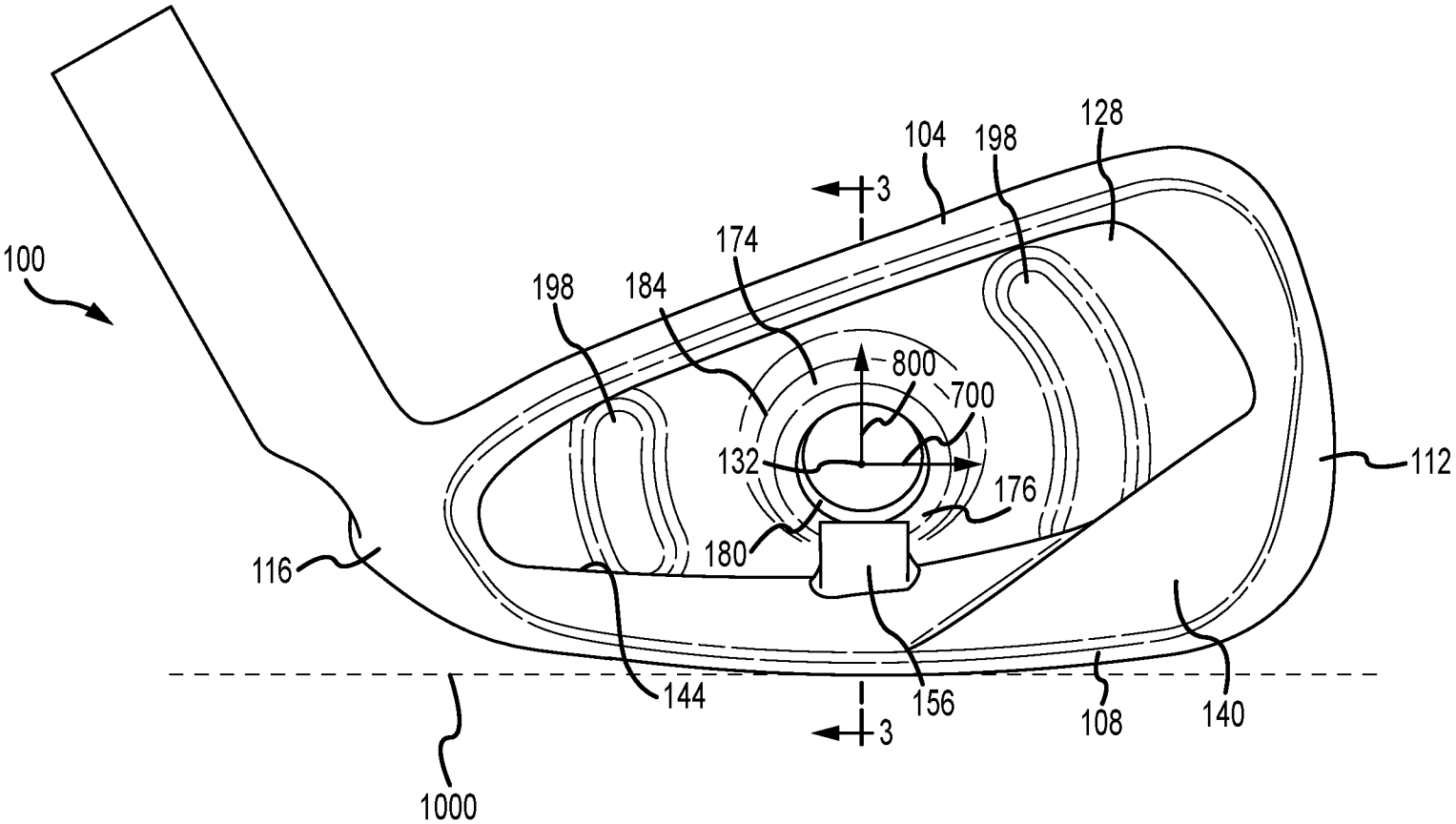
FIG. 2 illustrates a rear view of the iron-type club head of FIG. 1.

As illustrated in FIGS. 1 and 2, the club head 100 includes a face element 120. The face element 120 is integrally formed with the top rail 102, the sole 108, the toe end 112, and the heel 116 of the club head 100. The face element 120 includes a strike surface 124 intended to impact a golf ball, and a rear wall 128 opposite the strike surface 124. The strike surface 124 further defines a face center 132 located at a geometric center or midpoint of the strike surface 124. The face element 120 further defines a perimeter 136 that extends entirely around the face element 120 near the top rail 104, the heel end 116, the sole 108, and the toe end 112.

Figure 3:
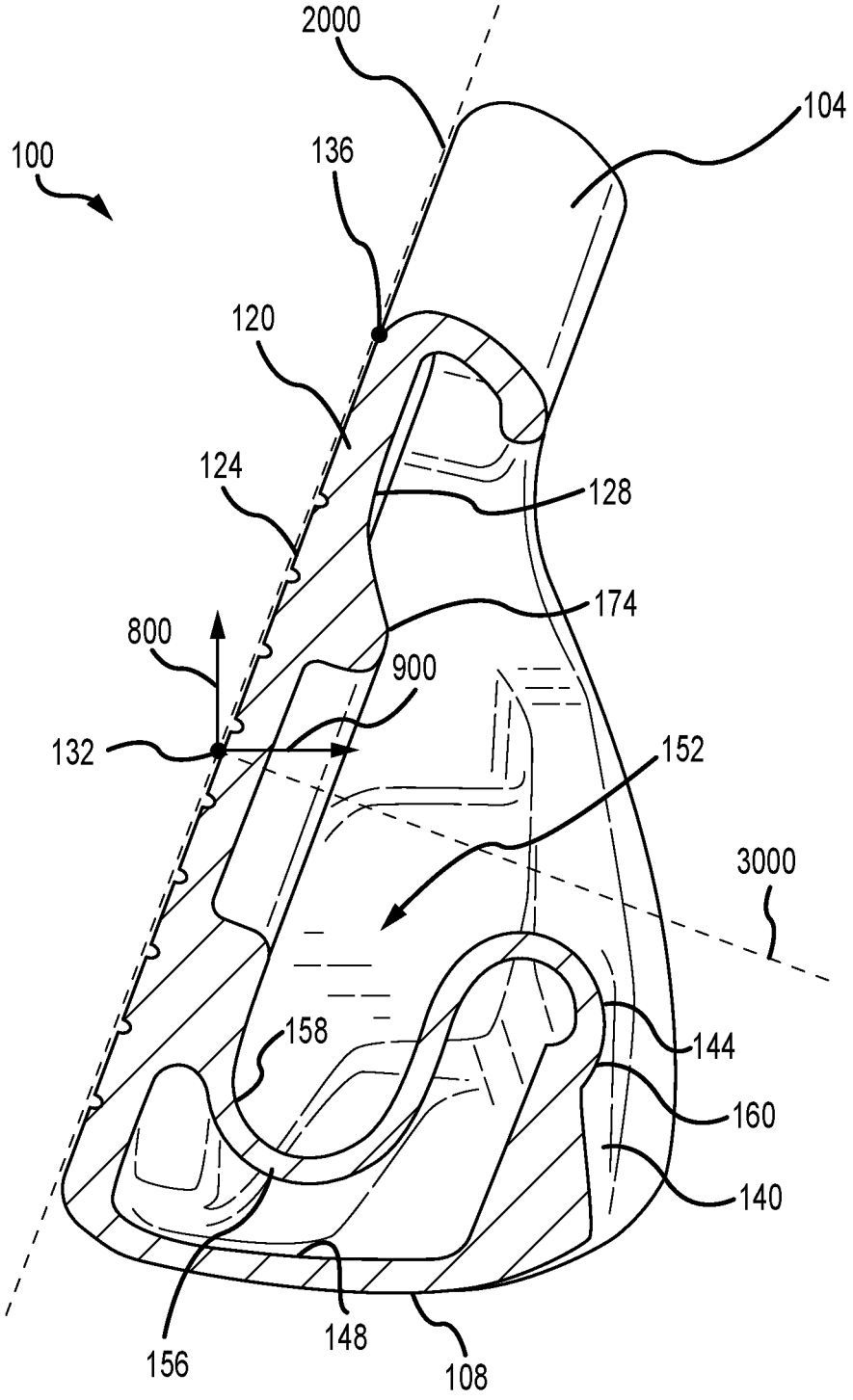
FIG. 3 illustrates a side cross sectional view of the iron-type club head of FIG. 1 taken at line 3-3 of FIG. 2.

Referring to FIGS. 1-3, the face center 132 of the strike surface 124 defines an origin for a coordinate system having an x-axis 700, a y-axis 800, and a z-axis 900. The club head 100 further defines a ground plane 1000 that is tangent to the sole 108 when the club head 100 is at an address position. The x-axis 700 extends through the face center 132 from near the heel end 116 to near the toe end 112 in a direction parallel to a ground plane 2000. The y-axis 800 extends through the face center 132 from near the top end 104 to near the bottom end 108, where the y-axis 800 is perpendicular to the x-axis 700 and to the ground plane 1000. The z-axis 900 extends through the face center 132 rearward the face element 120 in a direction parallel with the ground plane 1000. The z-axis 900 is perpendicular to the x-axis 700 and the y-axis 800.

Referring to FIG. 3, the club head 100 defines a loft plane 2000 that is tangent to the strike surface 124 and extends towards the top rail 104, the sole 108, the toe end 112, and the heel end 116. The loft plane 2000 is positioned at an acute angle with respect to the y-axis 800, wherein the acute angle can correspond to the loft angle of the club head 100. The club head 100 further defines a midplane 3000 that extends through the face center 132 in a direction perpendicular to the loft plane 2000. The midplane 3000 is positioned at an acute angle with respect to the z-axis 900. The midplane 3000 extends from near the toe end 112 to near the heel end 116 and extends rearward the face element 120 or the loft plane 2000. The midplane 3000 intersects the ground plane 1000 at a point away and rearward of the face element 120.

Referring to FIGS. 2 and 3, the club head includes a rear portion 140. The rear portion 140 is formed integrally with the sole 108 and extends in a direction towards the top rail 104. The rear portion 140 extends from the sole 108 to a top surface 144 of the rear portion 140. The rear portion 140 is formed integrally with the toe end 112 and the heel end 116 of the club head 100. As illustrated in FIG. 2, the rear portion 140 can cover a portion of the rear wall 128. The rear portion 140 can cover 5% to 25% of the rear wall 128. In some embodiments, the rear portion 140 can cover 5% to 15%, or 15% to 25% of the rear wall 128. In other embodiments, the rear portion 140 can cover 5% to 10%, 10% to 15%, 15% to 20%, or 20% to 25% of the rear wall 128. For example, the rear portion 140 can cover 5, 6, 7, 8, 9, 10, 11, 12, 13, 14, 15, 16, 17, 18, 19, 20, 21, 22, 23, 24, or 25% of the rear wall 128.

The club head 100 can further include a bottom interior wall 148 opposite the sole 108. The bottom wall 148 is formed integrally with the rear wall 128, the rear portion 140, the toe end 112, and the heel end 116. The bottom wall 128 connects the rear wall 128, the rear portion 140, the toe end 112, and the heel end 116 together. The rear wall 128, the rear portion 140, the bottom wall 148, the toe end 112, and the heel end 116 together form a channel 152. The channel 152 extends from the toe end 112 to the heel end 116. The channel 152 can define a space between the rear wall 128 of the face element 120 and the rear portion 140. Stated another way, the rear wall 128, the rear portion 140, the bottom wall 148, the toe end 112, and the heel end 116 together form a rear cavity 152. The rear cavity 152 extends from the toe end 112 to the heel end 116. The rear cavity 152 can define a space between the rear wall 128 of the face element 120 and the rear portion 140. The rear cavity 152 is not fully enclosed and can be viewed from a point outside the club head 100.

Flex Structure

As discussed above, the club head 100 comprises a flex structure and a face reinforcing structure. The flex structure can comprise a flex structure 156, and the face reinforcing structure can comprise a face reinforcing structure 174. The flex structure 156 generally extends between the rear wall 128 and the rear portion 140. The flex structure 156 is formed integrally with the rear wall 128 and the rear portion 140. Specifically, the flex structure 156 is formed integrally with the face reinforcing structure 174 and the rear portion 140. The club head 100 having one integral body that includes the flex structure 156 and the face reinforcing structure 174 provides greater face element bending while supporting the face element 120 during golf ball impacts. The flex structure 156 and the face reinforcing structure 174 allow for movement of large impact stresses away from the face element 120 and into the face reinforcing structure 174. Moving large impact stresses away from the face element 120 and into the face reinforcing structure 174 improves club head durability.

Figure 6:
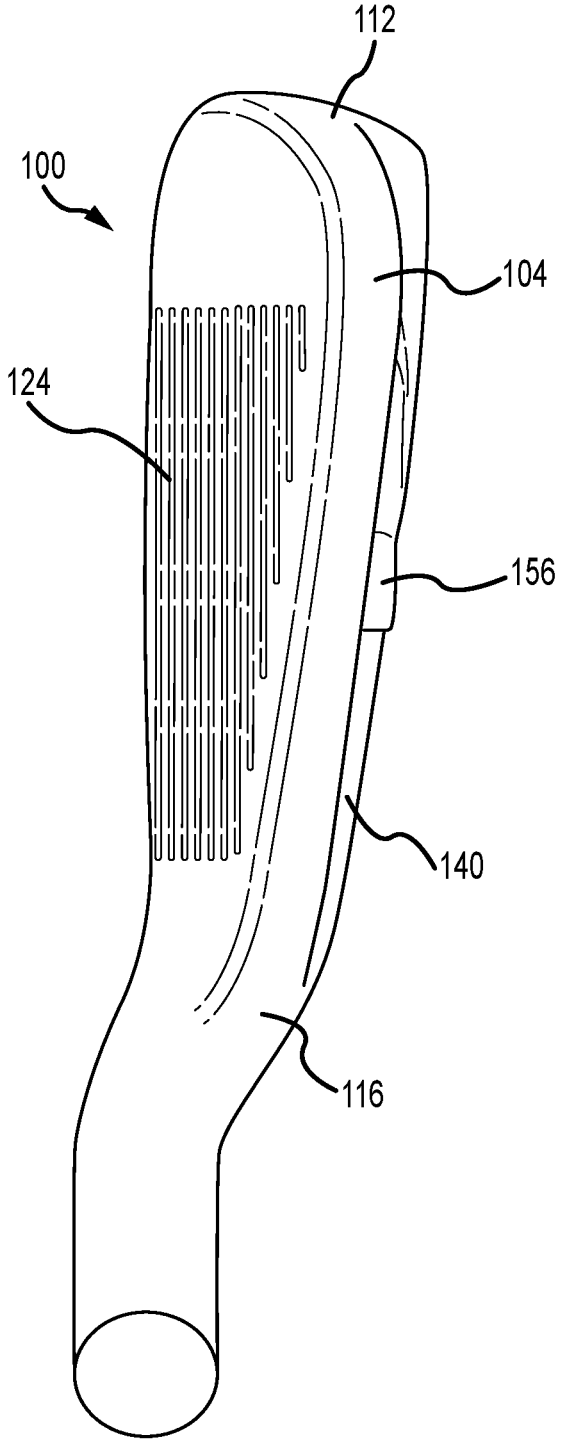
FIG. 6 illustrates a top view of the iron-type club head of FIG. 1.

Referring to FIGS. 3-6, the flex structure 156 can further define a first end 158 and a second end 160. The first end 158 of the flex structure 156 is formed integrally with the face reinforcing structure 174. Specifically, the first end 158 of the flex structure 156 is formed integrally with an outer perimeter surface 176 of the face reinforcing structure 174. The second end 160 of the flex structure 156 is formed integrally with the rear portion 140. Specifically, the second end 160 of the flex structure 156 is formed integrally with the top surface 144 of the rear portion 140. As illustrated in FIG. 6, the second end 160 of the flex structure 156 is attached or connected to the rear portion 140 such that the flex structure 156 is visible to a player's view when the club head 100 is at an address position. The flex structure 156 extends between the first end 158 and the second end 160 such that the flex structure 156 extends across the channel 152. The flex structure 156 extends across the channel 152 such that the flex structure 152 is spaced from the channel 152. The flex structure 156 does not contact the channel 152. Stated another way, the flex structure 156 is spaced from the bottom wall 148 such that the flex structure 156 does not contact the bottom wall 148.

The flex structure 156 can be parabolic, curved, S-shape, double curved, double bend, or sinusoidal in shape between the first end 158 and the second end 160. In some embodiments, the flex structure 156 can comprise one or more interconnected parabolas. In some embodiments, the flex structure 156 can comprise one or more interconnected bends. The curved nature of the flex structure 156 can define an apex 162 and a nadir 164. The apex 162 defines the highest or topmost portion of the flex structure 156 in relation to the top rail 104. The nadir 164 defines the lowest or bottommost portion of the flex structure 156 in relation to the sole 108. The flex structure 156 extends in a direction towards the sole 108 away from the face reinforcing structure 174 to form the nadir 164. The flex structure 156 then extends from the nadir 164 in a direction towards the top rail 104 to a height greater than the top surface 144 of the rear portion 140 to form the apex 162. The flex structure 156 then extends from the apex 162 in a direction towards the sole 108 to connect with the rear portion 144.

In one configuration, the apex 162 can be located above the top surface 144 of the rear portion 140. In another configuration, the apex 162 can be located below the top surface 144 of the rear portion 140. The nadir 164 of the flex structure 156 is spaced from the channel 152 such that the nadir 164 of the flex structure 156 does not contact the bottom wall 148. However, it would be appreciated that the curved nature of the flex structure 156 can provide more than one apex 162 and more than one nadir 164. In other embodiments, the flex structure 156 can comprise one, two, three, four, or five nadirs. In other embodiments still, the flex structure 156 can comprise one, two, three, four, or five apexes.

Further, the apex 162 and the nadir 164 of the flex structure 156 can further be referenced in relation to the structure of the club head 100 or in relation to the planes defined by the club head 100. In one configuration, both the apex 162 and the nadir 164 can be located below the midplane 3000. In another configuration, the apex 162 can be located above the midplane 3000, and the nadir 164 can be located below the midplane 3000 In another configuration, both the apex 162 and the nadir 164 can be located above the midplane 3000. In another configuration, the nadir 164 can be located closer to the face element 120 than the apex 162. In another configuration, the apex 162 can be located closer to the face element 120 than the nadir 164.

The flex structure 156 can further define a radius of curvature. The flex structure 156 can define more than one radius of curvature such as two, three, four, or five radii of curvature. In this first embodiment, the flex structure 156 defines a radius of curvature at the apex 162 and a radius of curvature at the nadir 164. In this first embodiment, the radius of curvature at the apex 162 and the radius of curvature at the nadir 164 are approximately equal. The radius of curvature at the apex 162 and the nadir 164 can range from 0.25 to 1 inch. In other embodiments, the radius of curvature at the apex 162 and the nadir 164 can range from 0.25 to 0.5 inch, or 0.5 to 1 inch. In other embodiments still, the radius of curvature at the apex 162 and the nadir 164 can range from 0.25 to 0.5 inch, 0.5 to 0.75 inch, or 0.75 to 1 inch. For example, the radius of curvature at the apex 162 and the nadir 164 can be 0.25, 0.30, 0.35, 0.40, 0.45, 0.50, 0.55, 0.60, 0.65, 0.70, 0.75, 0.80, 0.85, 0.90, or 1 inch. However, in other embodiments, the radius of curvature at the apex 162 and the radius of curvature at the nadir 164 can be different. In other embodiments, the radius of curvature at the apex 162 can be less than the radius of curvature at the nadir 164. In other embodiments still, the radius of curvature at the nadir 164 can be greater than the radius of curvature at the apex 162.

The flex structure 156 further defines an upper surface 168 and a lower surface 172. The upper surface 168 of the flex structure 156 faces the top rail 104 of the club head 100. The lower surface 172 of the flex structure faces the sole 108 of the club head 100. The flex structure 156 further defines a thickness measured between the upper surface 168 and the lower surface 172. The thickness of the flex structure 156 is defined as the distance between the upper surface 168 and the lower surface 172 measured in a direction perpendicular to either the upper surface 168 of the flex structure 156 or the lower surface 172 of the flex structure 156. In some embodiments, the thickness of the flex structure 156 can be constant between the first end 158 and the second end 160. In other embodiments, a portion of the flex structure 156 can comprise a tapered thickness. In one example, the first end 158 of the flex structure 156 can comprise a tapered thickness, where the thickness of the flex structure 156 is greater at the face reinforcing structure 174 and then decreases towards the nadir 164. In another example, the second end 160 of the flex structure 156 can comprise a tapered thickness, where the thickness of the flex structure 156 is greater at the rear portion 140 and then decreases towards the apex 162.

The thickness of the flex structure 156 can range from 0.04 to 0.2 inch. In some embodiments, the thickness of the flex structure 156 can range from 0.04 to 0.12 inch, or 0.12 to 0.20 inch. In other embodiments, the thickness of the flex structure 156 can range from 0.04 to 0.08 inch, 0.08 to 0.12 inch, 0.12 to 0.16 inch, or 0.16 to 0.20 inch. For example, the thickness of the flex structure 156 can be 0.04, 0.045, 0.05, 0.06, 0.07, 0.075 0.08, 0.09, 0.10, 0.11, 0.12, 0.13, 0.14, 0.15, 0.16, 0.17, 0.18, 0.19, or 0.20 inch. In one example, the thickness of the flex structure 156 can be 0.075 inch. In another example, the thickness of the flex structure 156 at the first end 158 can be 0.075 inch and then taper to a thickness of 0.045 inch near the nadir 164 of the flex structure 156. In another example, the thickness of the flex structure 156 at the second end 160 can be 0.075 inch and then taper to a thickness of 0.045 inch near the apex 162 of the flex structure 156.

The flex structure 156 defines a width. The width of the flex structure 156 is defined as a distance the flex structure 156 extends in the toe end 112 to heel end 116 direction. The width of the flex structure 156 can range from 0.1 to 1 inch. In some embodiments, the width of the flex structure 156 can range from 0.1 to 0.5 inch, or 0.5 to 1 inch. In some embodiments, the width of the flex structure 156 can range from 0.1 to 0.4 inch, 0.4 to 0.7 inch, 0.7 to 1 inch. For example, the width of the flex structure 156 can be 0.1, 0.15, 0.175, 0.18, 0.2, 0.3, 0.35, 0.40, 0.45, 0.50, 0.60, 0.70, 0.80, 0.90, or 1 inch. In one example, the width of the flex structure 156 can be 0.175 inch.

Figure 7:
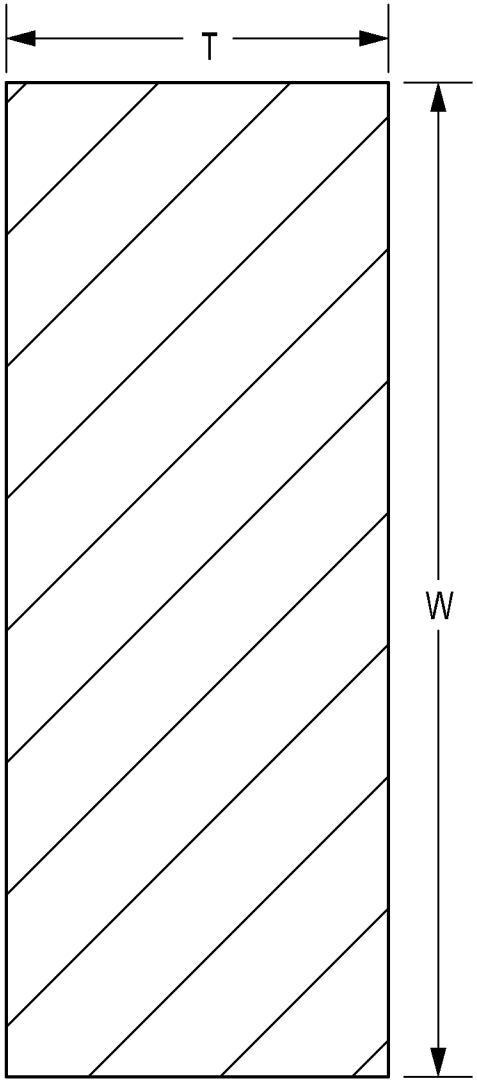
FIG. 7 illustrates a cross section of the flex structure of the iron-type club head of FIG. 1.

Referring to FIG. 7, the flex structure 156 comprises a cross sectional shape. The cross-sectional shape of the flex structure 156 can be a rectangle, a triangle, an ellipse, a rectangle with rounded corners, a square with rounded corners, or any other suitable shape. In the first embodiment of the present design, as illustrated in FIG. 7, the cross-sectional shape of the flex structure 156 is rectangular. The rectangular cross-sectional shape of the flex structure 156 defines a dimension T and a dimension W. The dimension T defines the thickness of the flex structure 156 and the dimension W defines the width of the flex structure 156. In one example, the dimension T can be 0.07 inch and the dimension W can be 0.18 inch.

Figure 8:
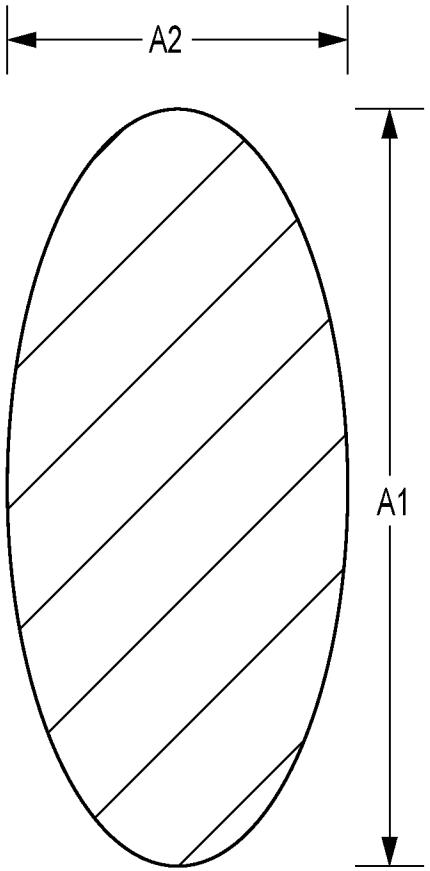
FIG. 8 illustrates a cross section of a flex structure according to an embodiment.
Figure 9:
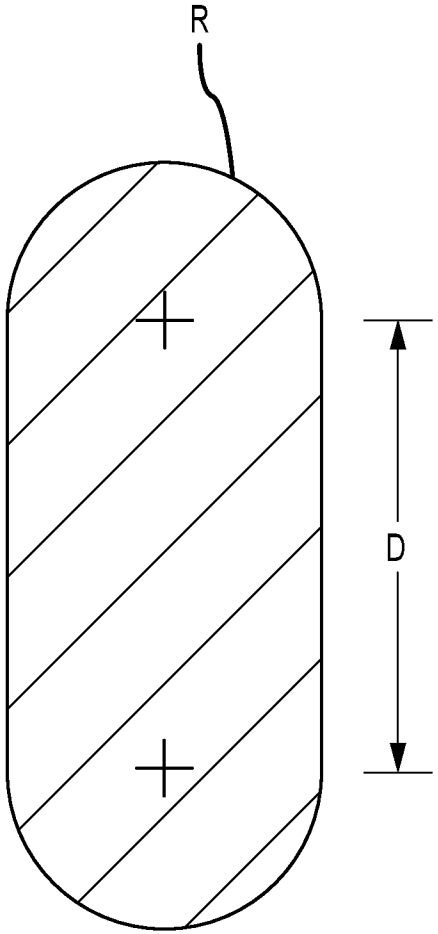
FIG. 9 illustrates a cross section of a flex structure according to an embodiment.

FIGS. 8 and 9 illustrated two alternate cross-sectional shape configurations. As illustrated in FIG. 8, the cross-sectional shape of the flex structure 156 can be elliptical. The elliptical cross-sectional shape defines a dimension A1 corresponding to a major axis, and a dimension A2 corresponding to a minor axis. The dimension A1 defines the width of the flex structure 156 and the dimension A2 defines the thickness of the flex structure 156. In one example, the dimension A1 can be 0.18 inch and the dimension A2 can be 0.08 inch. As illustrated in FIG. 9, the cross-sectional shape of the flex structure 156 can be a rectangle with rounded corners. The rectangular shape with rounded corners defines a R dimension, and a D dimension. The rectangle shape with rounded corners defines a rectangle and two half circles. The R dimension defines a radius of the half circles, and the D dimension defines a distance between the centers of the two half circles. In this embodiment, the thickness of the flex structure 156 is defined as two times the radius R dimension, and the width of the flex structure 156 is defined as two times the radius R dimension plus the D dimension. In one example, the radius R dimension can be 0.04 inch and the D dimension can be 0.10 inch, where the thickness of the flex structure 156 is 0.08 inch and the width of the flex structure 156 is 0.18 inch.

Face Reinforcing Structure

As discussed above, the club head 100 comprises a face reinforcing structure. The face reinforcing structure can comprise a face reinforcing structure 174. The face reinforcing structure 174 is formed integrally with the face element 120 and extends away from the rear wall 128. The face reinforcing structure 174 provides support to the face element 120 during golf ball impacts. Specifically, the face reinforcing structure 174 provides localized thickness on the face element 120 near the face center 132 thereby making the face element 120 stiffer and more rigid at locations around the face center 132. Since the face element 120 element is bending more due to the flex structure 156 and the variable face thickness, the face element 120 experiences larger stresses at golf ball impacts. The face reinforcing structure 174 transfers or moves the largest stresses away from the face element 120 and into the face reinforcing structure 174 thereby improving club head durability.

The face reinforcing structure 174 can comprise a rib. Specifically, the face reinforcing structure 174 can comprise a looped rib, a ring rib, a circular looped rib, or an elliptical looped rib that extends around the face center 132. The face reinforcing structure 174 can comprise a continuous closed looped structure around the face center 132. Closed structures are able to resist deformation as a result of circumferential (i.e., hoop) stresses acting on the face reinforcing structure 174. For example, circumferential stresses acting on the face reinforcing structure 174 prevent opposing sides of the face reinforcing structure 174 from rotating away from each other thereby stiffening the face element 120. This allows the face element 120 to be thinned at the face center 132 while directing stress away from the face element 120. This movement of the stress into the face reinforcing structure 174 improves the durability of the face element 120 and the club head 100.

Figure 4:
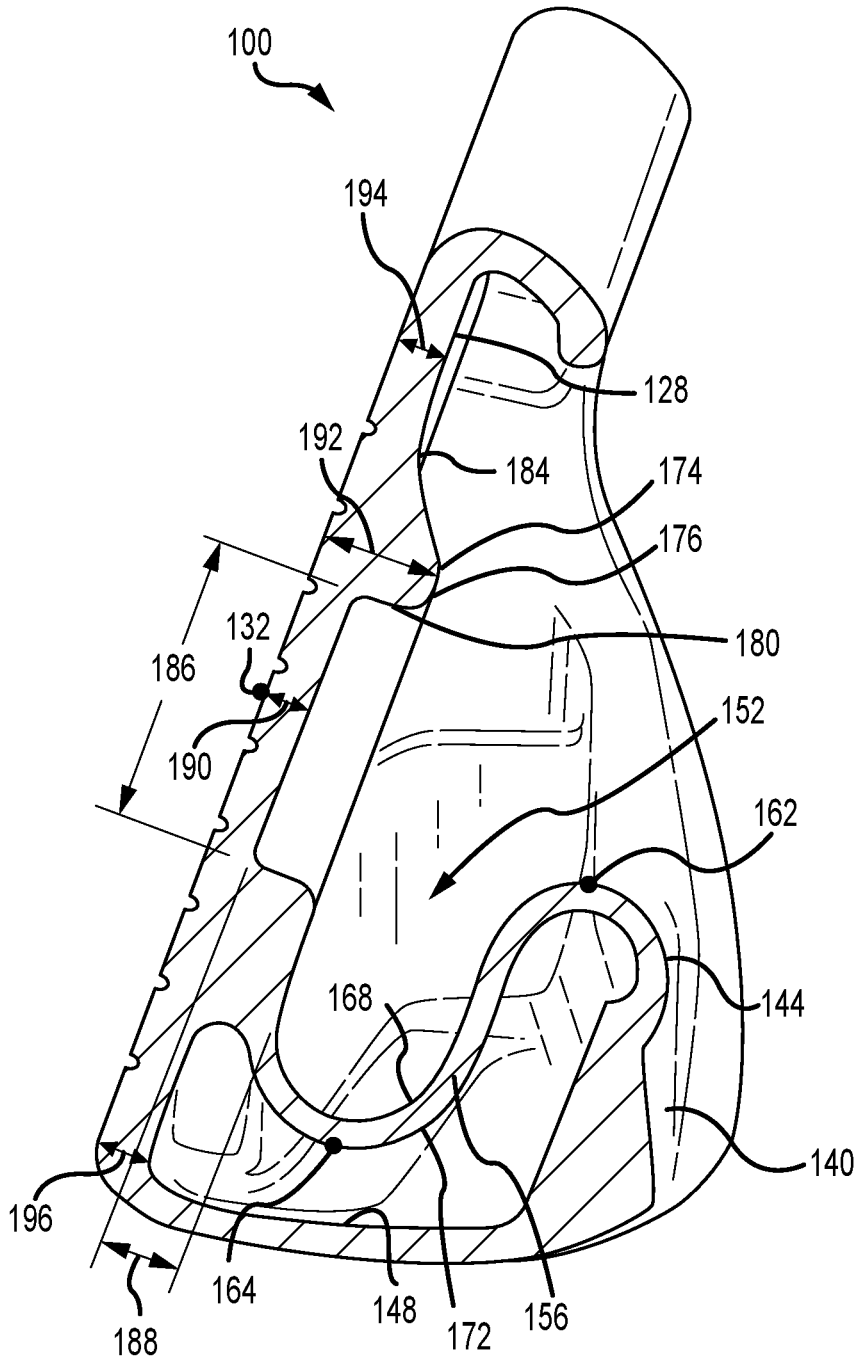
FIG. 4 illustrates a side cross sectional view of the iron-type club head of FIG. 1 taken at line 3-3 of FIG. 2.
Figure 5:
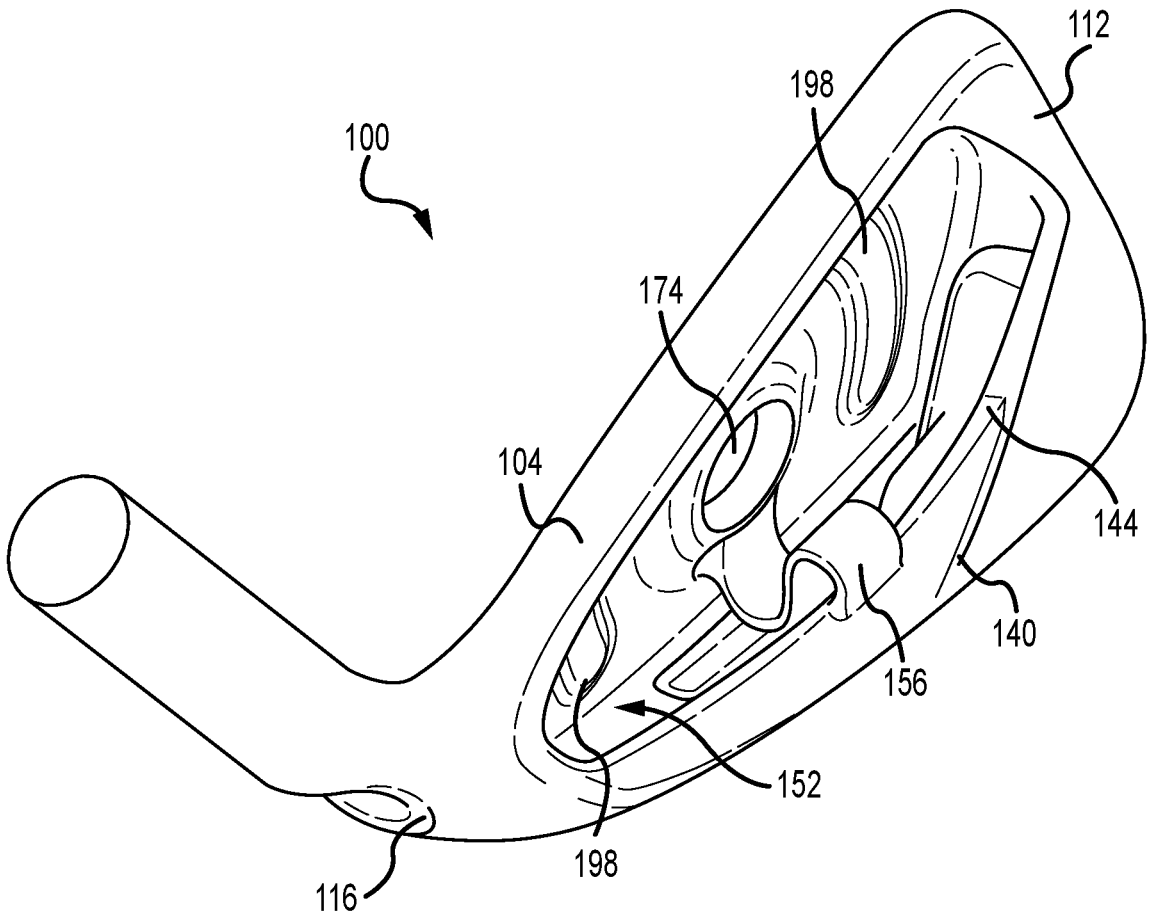
FIG. 5 illustrates a rear perspective view of the iron-type club head of FIG. 1.

Referring to FIG. 4, the face reinforcing structure 174 can comprise an outer perimeter surface 176 and an inner perimeter surface 180. The outer perimeter surface 176 is located at a maximum thickness of the face element 120. The outer perimeter surface 176 is located away from the rear wall 128 and can be substantially parallel with the rear wall 128. The outer perimeter surface 176 extends along the face reinforcing structure 176 and around the face center 132. The outer perimeter surface 176 is located adjacent the inner perimeter surface 180. The inner perimeter surface 180 is located within the face reinforcing structure 176 and extends substantially perpendicular to the rear wall 128. The inner perimeter surface 180 extends along the face reinforcing structure 176 and around the face center 132. The inner perimeter surface 180 is located between the rear wall 128 and the outer perimeter surface 176.

The face reinforcing structure 174 can be filleted with the rear wall 128 to provide a smooth transition between the face reinforcing structure 174 and the rear wall 128. Filleting the outer perimeter surface 176 with rear wall 128 directs impact stresses into the face reinforcing structure 174 and away from the face element 120. The club head 100 can comprise a fillet 184 between the outer perimeter surface 176 and the rear wall 128. The fillet 184 can comprise a radius that is greater than or equal to 0.012 centimeters. In some embodiments, the fillet 184 can range from 0.012 to 2.0 centimeters, 0.50 to 3.0 centimeters, or 1.0 to 4.0 centimeters. In other embodiments, the fillet 184 can range from 0.012 to 1.5 centimeters, 0.5 to 2.0 centimeters, 1.0 to 2.5 centimeters, 1.5 to 3.0 centimeters, 2.0 to 3.5 centimeters, or 2.5 to 4.0 centimeters. For example, the fillet 184 can be 0.012, 0.02, 0.05, 0.08, 0.1, 0.2, 0.5, 0.8, 1.0, 1.2, 1.5, 1.8, 2.0, 2.2, 2.5, 2.8, 3.0, 3.2, 3.5, 3.8, or 4.0 centimeters.

The face reinforcing structure 174 can further define a rib span 186. The rib span 186 is located within the face reinforcing structure 174 at the inner perimeter surface 180. The rib span 186 refers to the largest distance from one side of the inner perimeter surface 180 across an opposing side of the inner perimeter surface 180. The rib span 186 can refer to a diameter of the inner perimeter surface 180 of the face reinforcing structure 174. In embodiments where the looped rib 174 comprises an elliptical looped rib, the rib span 186 refers to the major axis of the inner perimeter surface 180. In embodiments where the looped rib 174 comprises a circular looped rib, the rib span 186 refers to the diameter of the inner perimeter surface 180.

The rib span 186 can be greater than or equal to 0.609 centimeters and less than or equal to 1.88 centimeters. In some embodiments, the rib span 186 can range from 0.609 to 1.2 centimeters, or 1.2 to 1.88 centimeters. In one example, the rib span 186 can be 1.0 centimeter. The rib span 186 is important for directing impact stresses away from the face element 120 and into the face reinforcing structure 174. When the rib span 186 is too large (i.e., greater than 1.88 centimeters), the face reinforcing structure 174 is insufficient in reinforcing the face element 120 near the face center 132. With rib spans 186 that are too large, the largest impact stresses occur at the face center 132 thereby causing the face element 120 to break or fail at the face center 132. Meanwhile, when the rib span 186 is too small (i.e., less than 0.609 centimeters), the face reinforcing structure 174 is insufficient in reinforcing the face element 120 near the face center 132. With rib spans 186 that are too small, the largest impact stresses occur in and around the face reinforcing structure 174 thereby causing the face element 120 to break or fail. When the rib span 186 is greater than or equal to 0.609 centimeters and less than or equal to 1.88 centimeters, the face reinforcing structure 174 reinforces the face element by directing the impact stresses away from the face element 120 (i.e., at the face center 132) and into the circular rib of the face reinforcing structure 174.

The inner perimeter surface 180 of the face reinforcing structure 174 can further define a rib height 188. The rib height 188 is measured between the rear wall 128 and the outer perimeter surface 176 in a direction perpendicular to the rear wall 128. In some embodiments, the rib height 188 can be greater than 0.30 centimeters, 0.40 centimeters, 0.50 centimeters, or 0.60 centimeters. In other embodiments, the rib height 188 can range from 0.30 to 0.7 centimeters. In some embodiments, the rib height 188 can range from 0.30 to 0.50 centimeters, 0.40 to 0.60 centimeters, or 0.50 to 0.70 centimeters. For example, the rib height 188 can be 0.30, 0.35, 0.40, 0.45, 0.50, 0.55, 0.60, 0.65, or 0.70 centimeters.

Face Element

As discussed above, the face element 120 can include a variable thickness. The face element 120 can comprise strategically placed thickened and thinned regions to support the face element 120 while increasing face element bending. The face element 120 can be thinnest at the face center 132 within the face reinforcing structure 174, and thickest at the outer perimeter surface 176 of the face reinforcing structure 174. The face element 120 can further include one or more thickness regions positioned away from the face reinforcing structure 174 to provide support to the toe and heel regions of the face element 120. In other embodiments, the face element 120 can be devoid of one or more thickness regions near the toe end 112 and the heel end 116 of the club head 100.

Referring to FIG. 4, the thickness of the face element 120 can vary from the toe end 114 to the heel end 118, from the top rail 104 to the sole 108, or any combination thereof. The thickness of the face element 120 can help distribute stress and allow for the face element 120 to further bend during golf ball impacts. The face element 120 comprises a first thickness 190, a second thickness 192, a third thickness 194, and a fourth thickness 196. The first thickness 190 of the face element 120 is measured from the face center 134 to the rear wall 120 in a direction perpendicular to the loft plane 2000 or strike surface 124. The first thickness 190 can be a minimum thickness of the face element 120. The first thickness 190 can refer to a center thickness of the face element 120. In some embodiments, the first thickness 190 can range from 0.055 inch to 0.085 inch. In other embodiments, the first thickness 190 can range from 0.055 inch to 0.07 inch, or 0.07 to 0.085 inch. For example, the first thickness 190 can be 0.055, 0.06, 0.065, 0.07, 0.075, 0.08, or 0.085 inch. In one example, the first thickness 190 can be 0.075 inch.

The second thickness 192 of the face element 120 is measured from the strike surface 124 to the outer perimeter surface 176 of the face reinforcing structure 174 in a direction perpendicular to the loft plane 2000 or strike surface 124. The second thickness 192 can be a maximum thickness of the face element 120. The second thickness 192 can range from 0.10 inch to 0.30 inch. In other embodiments, the second thickness 192 can range from 0.10 inch to 0.20 inch, or 0.20 inch to 0.30 inch. In other embodiments, the second thickness 192 can range from 0.10 to 0.15 inch, 0.15 to 0.20 inch, 0.20 to 0.25 inch, or 0.25 to 0.30 inch. For example, the second thickness 192 can be 0.10, 0.15, 0.16, 0.17, 0.18, 0.188, 0.19, 0.198, 0.20, 0.25, or 0.30 inch. In one example, the second thickness 192 can be 0.198 inch.

The third thickness 194 of the face element 120 is measured from the strike surface 124 to the rear wall 128 in a direction perpendicular to the loft plane 2000 or strike surface 124. The third thickness 194 of the face element 120 is at locations on the face element 120 devoid of the face reinforcing structure 174 and the thickness regions 198. The third thickness 194 can be greater than first thickness 190. The third thickness 194 can be less than the second thickness 192. In some embodiments, the third thickness 194 can range from 0.05 inch to 0.15 inch. In other embodiments, the third thickness 194 can range from 0.05 inch to 0.10 inch, or 0.10 inch to 0.15 inch. For example, the third thickness 194 can be 0.05, 0.055, 0.06, 0.065, 0.07, 0.075, 0.08, 0.085, 0.09, 0.095, 0.10, 0.11, 0.12, 0.13, 0.14, or 0.15 inch. In one example, the third thickness 194 can be 0.083 inch.

The fourth thickness 196 of the face element 120 is measured from the strike surface 124 to the rear wall 128 in a direction perpendicular to the loft plane 2000 or strike surface 124. The fourth thickness 192 of the face element 120 is located at the face perimeter 130. The fourth thickness 196 can refer to a perimeter thickness of the face element 120. In some embodiments, the fourth thickness 196 and the third thickness 192 can be equal. In other embodiments, the fourth thickness 196 can be greater than the third thickness 192. In other embodiments, the fourth thickness 196 can be greater than the first thickness 190. In other embodiments still, the fourth thickness can be less than the second thickness 192. In some embodiments, the fourth thickness 196 can range from 0.05 inch to 0.15 inch. In other embodiments, the fourth thickness 196 can range from 0.05 inch to 0.10 inch, or 0.10 inch to 0.15 inch. For example, the fourth thickness 196 can be 0.05, 0.055, 0.06, 0.065, 0.07, 0.075, 0.08, 0.085, 0.09, 0.095, 0.10, 0.11, 0.12, 0.13, 0.14, or 0.15 inch. In one example, the fourth thickness 196 can be 0.083 inch.

Referring back to FIGS. 2 and 5, the face element 120 can further include one or more thickness regions 198. The thickness regions 198 can be thickened regions on the face element 120 at locations devoid of the face reinforcing structure 174. The thickness regions 198 are located away or outside the face reinforcing structure 174. The thickness regions 198 can be positioned near the toe end 112 and the heel end 116 of the club head 100. The thickness regions 198 provide support to the face element 120 for golf ball impacts near the toe end 112 and the heel end 116.

The thickness regions 198 can comprise a shape. The thickness regions 198 can comprise a semi-circular shape, a C-shape, a kidney bean shape, or any other suitable shapes. The thickness regions 198 can be positioned in relation to the midplane 3000. In some embodiments, the thickness regions 198 can be located above the midplane 3000. In other embodiments, the thickness regions 198 can be located below the midplane 3000. In other embodiments, a first thickness region 198 can be located above the midplane 3000, and a second thickness region 198 can be located below the midplane 3000. In other embodiments, a portion of a thickness region 198 can be located above the midplane 3000, and another portion of the thickness region 198 can be located below the midplane 3000. The positioning of the thickness regions 198 in relation to the midplane 3000 provide adjustability of the stiffness and rigidity at the heel and toe regions of the face element 120. The thickness regions 198 provide additional support to the face element 120 for golf ball impacts near the heel and toe regions of the face element 120.

The thickness regions 198 can range from 0.08 to 0.16 inch. In some embodiments, the thickness regions 198 can range from 0.08 to 0.12 inch, or 0.12 to 0.16 inch. In other embodiments, the thickness regions 198 can range from 0.08 to 0.10 inch, 0.10 to 0.12 inch, 0.12 to 0.14 inch, or 0.14 to 0.16 inch. For example, the thickness regions 198 can be 0.08, 0.09, 0.10, 0.108, 0.11, 0.12, 0.13, 0.14, 0.15, or 0.16 inch. In one example, the thickness regions 198 can be 0.108 inch.

Additional Embodiments

Figure 11:
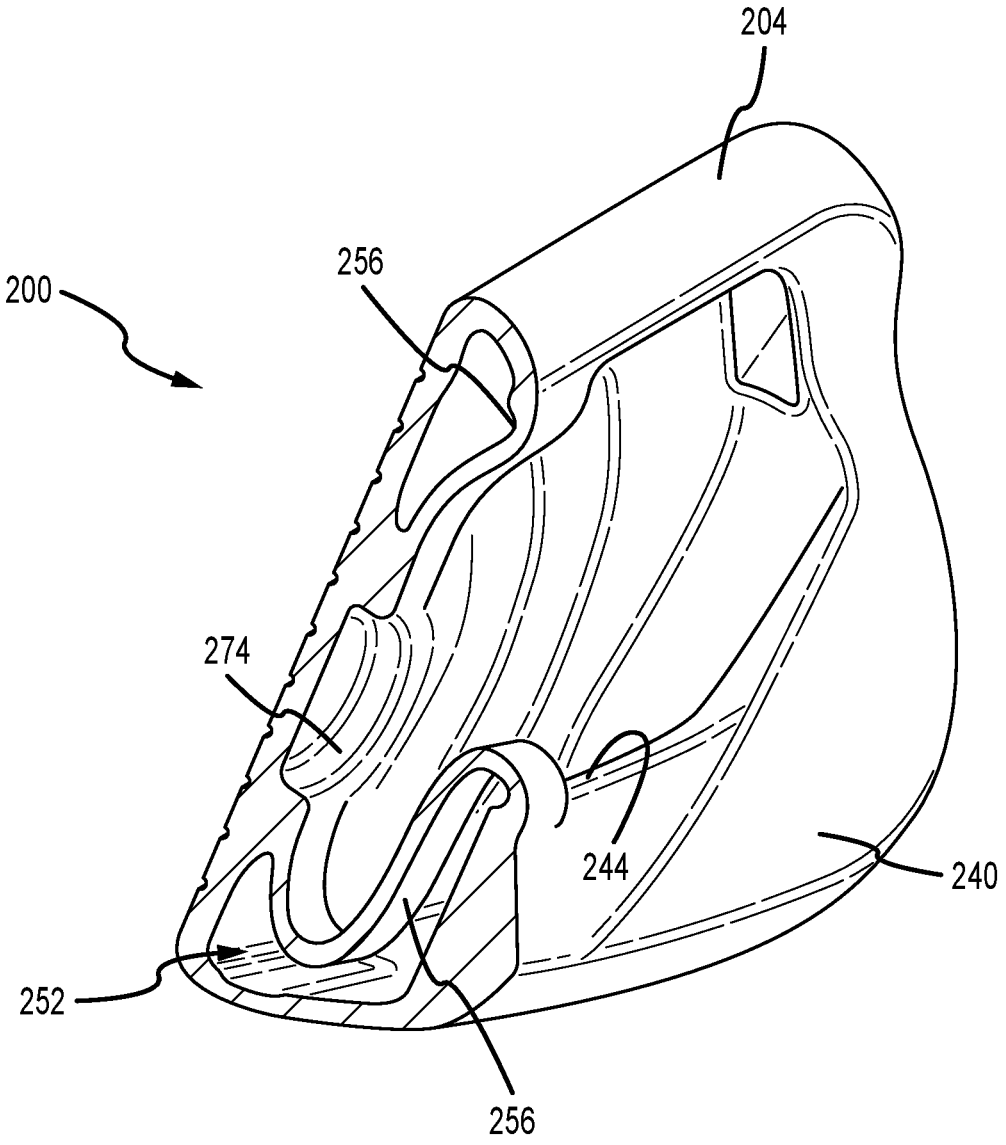
FIG. 11 illustrates a cross sectional view of the iron-type club head of FIG. 10 taken at line 11-11 of FIG. 10.
Figure 12:
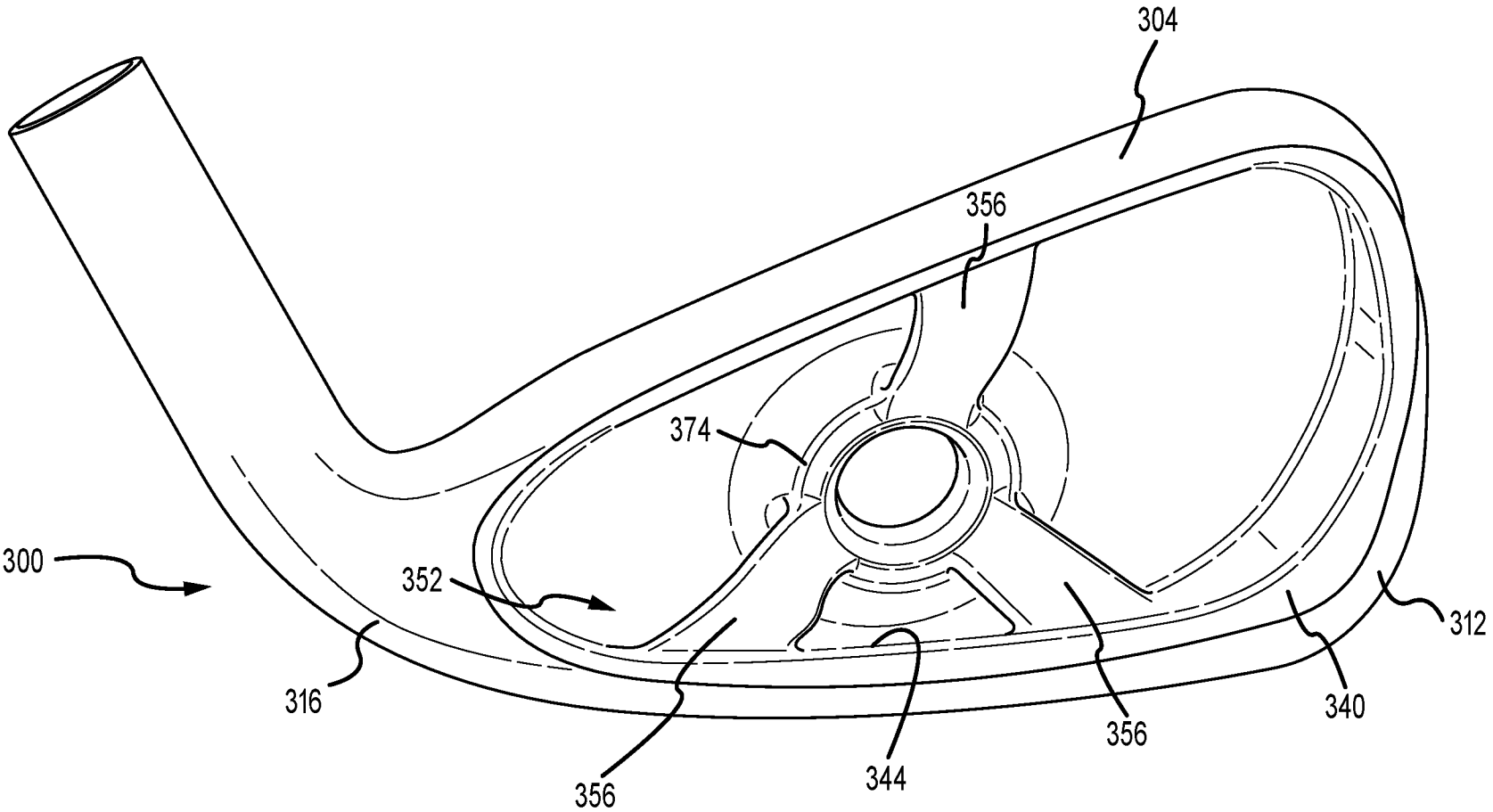
FIG. 12 illustrates a rear perspective view of an iron-type club head according to another embodiment.
Figure 13:
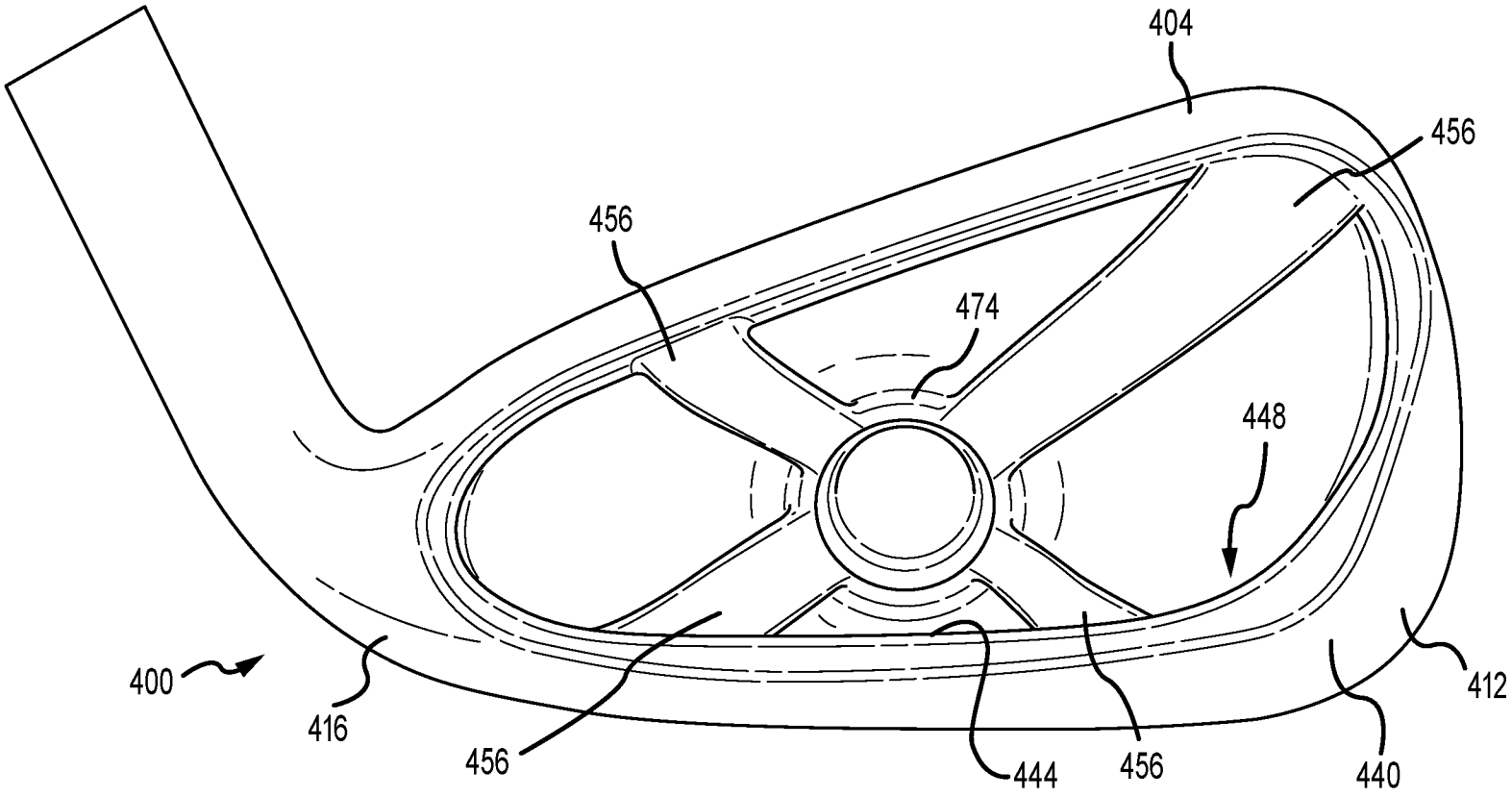
FIG. 13 illustrates a rear perspective view of an iron-type club head according to another embodiment.

While FIGS. 1-6 illustrated a first embodiment of how the present technology may be employed, FIGS. 11-13 schematically illustrate three alternate configurations. In each embodiment (including the embodiment shown in FIGS. 1-6), the iron-type club head includes a flex structure, a face reinforcing structure, and a variable face element thickness to increase face element bending while improving club head durability. The iron-type club heads shown in FIGS. 11-13 can be similar to the club head 100 as shown in FIGS. 1-6 but differ in the number of flex structures.

Figure 10:
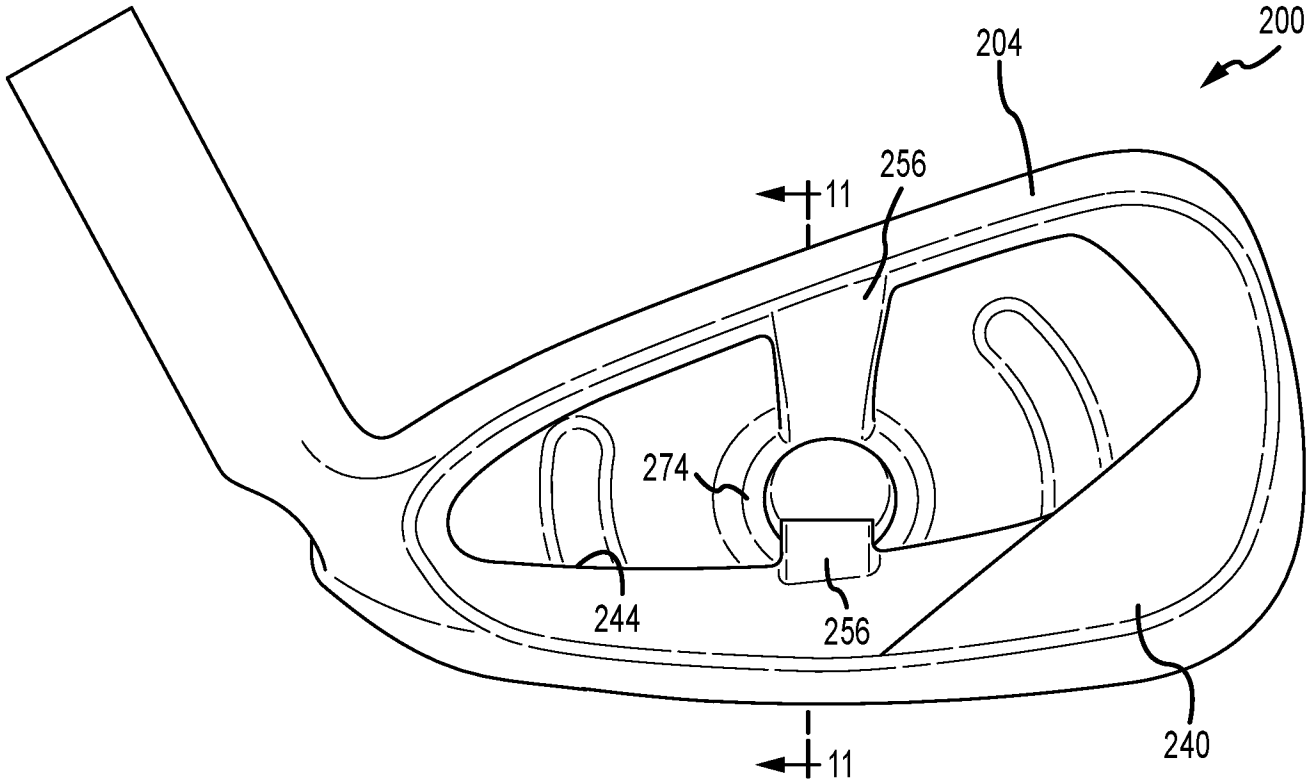
FIG. 10 illustrates a rear view of an iron-type club head according to another embodiment.

In one embodiment, as illustrated in FIGS. 10 and 11, the iron-type club head can comprise an iron-type club head 200. The club head 200 comprises a first flex structure 256, a second flex structure 256, and a face reinforcing structure 274. In this embodiment, a first flex structure 256 can be formed integrally with the face reinforcing structure 256 and a rear portion 240, and a second flex structure 256 can be formed integrally with the face reinforcing structure 256 and a top rail 204. The first flex structure 256 and the second flex structure 256 can be positioned around the outer perimeter surface of the face reinforcing structure 274 such that the flex structures 256 are spaced approximately 180 degrees from each other.

In another embodiment, as illustrated in FIG. 12, the iron-type club head can comprise an iron-type club head 300. The club head 300 comprises a first flex structure 356, a second flex structure 356, a third flex structure, and face reinforcing structure 374. In this embodiment, a first flex structure 356 is formed integrally with the face reinforcing structure 374 and a rear portion 340 near the toe end 312 of the club head 300. A second flex structure 356 can be formed integrally with the face reinforcing structure 374 and the rear portion 340 near the heel end 318 of the club head 300. A third flex structure 356 can be formed integrally with the face reinforcing structure 356 and a top rail 304. The first flex structure 152, the second flex structure 152, and the third flex structure 152 can be positioned around the outer perimeter of the face reinforcing structure 374 such that the flex structures 356 can be spaced approximately 60 degrees from each other.

In another embodiment, as illustrated in FIG. 13, the iron-type club head can comprise an iron-type club head 400. The club head comprises a first flex structure 456, a second flex structure 456, a third flex structure 456, a fourth flex structure 456, and a face reinforcing structure 474. In this embodiment, a first flex structure 456 can be formed integrally with the face reinforcing structure 474 and a rear portion 440 near the toe end 412 of the club head 400. A second flex structure 456 can be formed integrally with the face reinforcing structure 474 and the rear portion 440 near the heel end 418 of the club head 400. A third flex structure 456 can be formed integrally with the face reinforcing structure 456 and a top rail 404 near the toe end 412 of the club head 400. A fourth flex structure 456 can be formed integrally with the face reinforcing structure 456 and the top rail 404 near the heel end 416 of the club head 400. The first flex structure 456, the second flex structure 456, the third flex structure 456, and the fourth flex structure 456 can be positioned around the outer perimeter of the face reinforcing structure 474 such that the flex structures 456 can be spaced approximately 45 degrees from each other.

Method of Manufacturing

A method of manufacturing a club head 100 having a flex structure 156, a face reinforcing structure 174, and a face element 120 with a variable thickness is provided. The method includes providing an integrally formed club head 100. The method includes providing the club head 100 having the top rail 104, the sole 108, the toe end 112, the heel end 116, and the rear portion 140. The method includes providing the face element 120 having the strike surface 124 and the rear wall 128. The method further includes providing the flex structure 156 and the face reinforcing structure 174. The flex structure 156 and the face reinforcing structure 174 are formed integrally with the face element 120. The club head 100 may be formed through any suitable manufacturing process that may be used to form an integral body. The club head 100 may be formed from a metal using processes such as casting, die casting, co die casting, additive manufacturing, or metallic 3D printing. Examples of metals may include, for example, but not limited to, steel, steel alloy, stainless steel, stainless steel alloy, C300, C350, Ni (Nickel)-Co(Cobalt)-Cr(Chromium)-Steel Alloy, 8620 alloy steel, S25C steel, 303 SS, 17-4 SS, carbon steel, maraging steel, 565 Steel, AISI type 304 or AISI type 630 stainless steel, titanium alloy, Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 Titanium alloy, amorphous metal alloy, or other similar metals.

Benefits

The flex structure 156 and the face reinforcing structure 174 provide support to the face element 120 such that the entire face element 120 can be thinned to provide greater face element bending. The face reinforcing structure 174 provides an avenue to redirect impact stresses from the face element 120 and into the outer perimeter surface 176 of the face reinforcing structure 174. The movement of impact stresses from the face element 120 and into the face reinforcing structure 174 improves the durability of the face element 120 and the club head 100. The thickness of the face element 120, within the diameter of the face reinforcing structure 174 and near the face center 132, can be thinner than the thickness of the face element 120 at the outer perimeter surface 176 of the face reinforcing structure 174, locations devoid of the face reinforcing structure 174, and the face perimeter 136. The combination of the flex structure 156 and the face reinforcing structure 174 allow for an overall thinner face element 120 compared to face elements devoid of the flex structure and/or face reinforcing structure. The club head 100 having the combination of the flex structure 156, the face reinforcing structure 174, and the face element 120 with the variable thickness allows for an internal energy increase of 3.7 lbf-in compared to club heads devoid of the flex structure, the face reinforcing structure, and the variable face element thickness. An internal energy increase of 3.7 lbf-in equates to approximately a 0.5 mph increase in ball speed and approximately a 4 to 7 yard increase in distance.

The face element 120 of the club head 100 can be 5 to 20% thinner compared to a face element or strikeface devoid of the flex structure and/or face reinforcing structure. In some embodiments, the face element 120 can be 5 to 10%, or 10 to 20% thinner compared to a face element or strikeface devoid of the flex structure and/or face reinforcing structure. In other embodiments, the face element 120 can be 5, 6, 7, 8, 9, 10, 12, 14, 16, 18, or 20% thinner compared to a face element or strikeface devoid of the flex structure and/or face reinforcing structure.

In an exemplary embodiment, but not limited to, the club head 100 was compared to a control club head. The club head 100 includes the flex structure 156 and the face reinforcing structure 174. The control club head includes a face reinforcing structure similar to the face reinforcing structure 174 but is devoid of the flex structure 156. The club head 100 includes a first thickness 190 of 0.075 inch, a second thickness 192 of 0.198 inch, a third thickness 194 of 0.083 inch, and a fourth thickness 196 of 0.083 inch (i.e., perimeter thickness 196). The control club head includes a first thickness of 0.075 inch, a second thickness of 0.188 inch, a third thickness of 0.088 inch, and a fourth thickness of 0.088 inch (i.e., perimeter thickness 196). The club head 100 can be 5 to 7% thinner at or near the perimeter of the face element 120 compared to the control club head. The flex structure 156 and the face reinforcing structure 174 of the club head 100 allow for an overall thinner face element 120 compared to a club head devoid of the flex structure 156.

The club head 100 with flex structure 156 has many improvements compared to known iron type club heads. The flex structure 156 reinforces the face element 120 without the need for an insert or material backing the face element 120. Combined with the face reinforcing structure 174, the flex structure 156 and the face reinforcing structure 174 can absorb and direct impact stresses away from the thinned face element 120 and into the face reinforcing structure 174. The face reinforcing structure 174 provides support to the face element 120 to maintain or improve club head durability.

The flex structure 156 having the curved profile functions like a spring to support the face element 120 during golf ball impacts. As the face element 120 bends under the impact forces, the face element 120 and the flex structure 156 bend towards the rear portion 140. Due to the curved profile of the flex structure 156, the flex structure 156 bends inward at the nadir 164 and at the apex 162. In this first embodiment, the flex structure 156 bends greater at the nadir 164 than at the apex 162 because the nadir 164 is closest to the source of the largest forces (i.e., impact forces on face element 120). As the face element 120 bends, the stresses within the face element 120 move towards the face reinforcing structure 174 and away from the face center 132 of the face element 120. The stresses move away from the face element 120 and up into the outer perimeter surface 176 of the face reinforcing structure 174. The movement of stresses prevents the face element 120 from failing under the impact forces. The movement of stresses improves the durability of the face element 120 and the club head 100.

EXAMPLES

Example 1—Ball Speed Tests for Iron-Type Club Head

An exemplary iron-type club head 100 comprising the face reinforcing structure and the flex structure was compared to a similar control iron-type club head comprising the face reinforcing structure, but devoid of the flex structure and a reduced perimeter thickness. The exemplary iron-type club head 100 comprises the face reinforcing structure, the flex structure, and a fourth or perimeter thickness of 0.079 inch. The control iron-type club head comprises the face reinforcing structure, and a perimeter thickness of 0.088 inch.

A test was conducted to compare the golf ball speed between the exemplary iron-type club head 100 and the control iron-type club head. The test used an air cannon that fired golf balls at each club head. The distance the air cannon was positioned from each club head was held constant, and each club head was held in an address position (i.e., loft was not added or reduced during the test). The test compared the golf ball speed off the strike face over many golf ball impacts. The test resulted in the exemplary iron-type club head 100 averaging a golf ball speed of 124.9 mph, and the control iron-type club head averaging a golf ball speed of 124.5 mph. The results show that the exemplary iron-type club head 100 had average 0.5 mph greater ball speed than the control iron-type club head. An increase of 0.5 mph ball speed approximately equates to a 4 to 7 yard increase in ball distance. The combination of the face reinforcing structure, the flex structure, and the reduced perimeter thickness provides greater golf ball speed thereby increasing the carry distance of the golf ball.

Example 2—Ball Spin Tests for Iron-Type Club Head

An exemplary iron-type club head 100 comprising the face reinforcing structure and the flex structure was compared to a similar control iron-type club head comprising the face reinforcing structure, but devoid of the flex structure and a reduced perimeter thickness. The exemplary iron-type club head 100 comprises the face reinforcing structure, the flex structure, and a fourth or perimeter thickness of 0.079 inch. The control iron-type club head comprises the face reinforcing structure, and a perimeter thickness of 0.088 inch.

A test was conducted to compare the golf ball spin (i.e., backspin) between the exemplary iron-type club head 100 and the control iron-type club head. The test entailed measuring the ball spin imparted from the strike face of each club head while keeping the club head dimensions, loft angle, shaft properties, and weather conditions constant. The test resulted in the exemplary iron-type club head 100 averaging a golf ball spin of 6710 rpm, and the control iron-type club head averaging a golf ball spin of 6517 rpm. The results show that the exemplary iron-type club head 100 average about 200 rpm greater golf ball spin than the control iron-type club head. The combination of the face reinforcing structure, the flex structure, and the reduced perimeter thickness provides greater ball spin and better control of the golf ball.

Example 3—Stat Area Tests for Iron-Type Club Head

An exemplary iron-type club head 100 comprising the face reinforcing structure and the flex structure was compared to a similar control iron-type club head comprising the face reinforcing structure, but devoid of the flex structure and a reduced perimeter thickness. The exemplary iron-type club head 100 comprises the face reinforcing structure, the flex structure, and a fourth or perimeter thickness of 0.079 inch. The control iron-type club head comprises the face reinforcing structure, and a perimeter thickness of 0.088 inch.

A test was conducted to compare the stat area (i.e., standard deviation of a collection of golf ball carry distances multiplied by the standard deviation of a collection of golf ball offline distances) between the exemplary iron-type club head 100 and the control iron-type club head. The golf ball carry distance is a distance the golf ball travels in the air. The golf ball offline distance is a distance the golf ball is offset from a line extending from the player to the desired target. The golf ball offline distance is measured perpendicular to the line extending from the player to the desired target. The stat area determines the precision of the grouping or dispersion for a collection of golf ball shots, where a tighter dispersion indicates a lower stat area, and a larger dispersion indicates a higher stat area. The test resulted in the exemplary iron-type club head 100 averaging a 32.8% decrease in stat area compared the control iron-type club head. The combination of the face reinforcing structure, the flex structure, and the reduced perimeter thickness provides a desirable lower stat area to allow for a greater precision in golf ball shot dispersion.

Example 4—Internal Energy Tests for Iron-Type Club Head

An exemplary iron-type club head 100 comprising the face reinforcing structure and the flex structure was compared to a similar control iron-type club head comprising the face reinforcing structure, but devoid of the flex structure and a reduced perimeter thickness. The exemplary iron-type club head 100 comprises the face reinforcing structure, the flex structure, and a fourth or perimeter thickness of 0.079 inch. The control iron-type club head comprises the face reinforcing structure, and a perimeter thickness of 0.088 inch.

A test was conducted to compare the internal energy between the exemplary iron-type club head 100 and the control iron-type club head. The test used finite element simulations to measure the internal energy of the club heads during a 100-mph golf ball impact speed. The test resulted in the exemplary iron-type club head 100 averaging a peak internal energy increase of 3.7 lbf-in over the control club head. An internal energy increase of 3.7 lbf-in equates roughly to a 0.5 mph increase in ball speed. An increase of 0.5 mph ball speed approximately equates to a 4 to 7 yard increase in ball distance. The combination of the flex structure and the face reinforcing structure provides support to the face element while increasing face element bending and ball speed.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. A golf club head comprising: a top rail; a sole opposite the top rail; a toe end; a heel end opposite the toe end; a rear portion connected to the sole and extending towards the top rail; a face element comprising: a strike surface; and a rear wall opposite the strike surface; a reinforcement structure formed integrally with the face element; a flex structure formed integrally with the face element and the rear portion; wherein: the face element defines a face center; the reinforcement structure comprises a circular looped rib that extends away from the rear wall and around the face center; and the flex structure comprises a first end formed integrally with the face reinforcing structure, and a second end formed integrally with the rear portion.

Clause 2. The golf club head of clause 1, wherein the club head further comprises a bottom wall located opposite the sole that connects the rear wall, the rear portion, the toe end, and the heel end together; wherein the rear wall, the rear portion, the toe end, the heel end, and the bottom wall together form a channel; and wherein the flex structure extends within the channel such that the flex structure does not contact the channel.

Clause 3. The golf club head of clause 1, wherein the flex structure comprises a curved shape; and wherein the flex structure comprises a nadir defining a lowermost portion of the flex structure, and an apex defining a topmost portion of the flex structure.

Clause 4. The golf club head of clause 3, wherein the club head further defines a midplane that extends rearward the face center and towards the toe end and the heel end; wherein the nadir and the apex of the midplane are below the midplane.

Clause 5. The golf club head of clause 1, wherein the face reinforcement structure comprises: an inner perimeter surface located within the face reinforcement structure and extending perpendicular to the rear wall; and an outer perimeter surface located at a largest thickness of the face element and adjacent the inner perimeter surface.

Clause 6. The golf club head of clause 5, wherein the inner perimeter surface defines a rib span greater than or equal to 0.609 centimeters and less than or equal to 1.88 centimeters.

Clause 7. The golf club head of clause 5, wherein the face element comprises a variable thickness having: a first thickness measured from the face center to the rear wall in a direction perpendicular to the strike face; a second thickness measured from the strike face to the outer perimeter surface of the face reinforcing structure in a direction perpendicular to the strike face; a third thickness measured from the strike face to the rear wall devoid of the reinforcement element in a direction perpendicular to the strike face; and a fourth thickness measured from the strike face to the rear wall at the face perimeter in a direction perpendicular to the strike face; wherein the first thickness is a minimum thickness of the face element; and wherein the second thickness is a maximum thickness of the face element.

Clause 8. A golf club head comprising: a top rail; a sole opposite the top rail; a toe end; a heel end opposite the toe end; a bottom wall opposite the sole; a rear portion connected to the sole and extending towards the top rail; a face element comprising: a strike surface; and a rear wall opposite the strike surface; a reinforcement structure formed integrally with the face element; a flex structure formed integrally with the face element and the rear portion; wherein: the face element defines a face center; the reinforcement structure comprises a circular looped rib that extends away from the rear wall and around the face center; the flex structure comprises a first end formed integrally with the face reinforcing structure, and a second end formed integrally with the rear portion; the rear wall, the rear portion, the toe end, the heel end, and the bottom wall together form a channel; and the flex structure extends across the channel such that the flex structure does not contact the channel.

Clause 9. The golf club head of clause 8, wherein the flex structure comprises a curved shape; and wherein the flex structure comprises a nadir defining a lowermost portion of the flex structure, and an apex defining a topmost portion of the flex structure.

Clause 10. The golf club head of clause 9, wherein the club head further defines a midplane that extends rearward the face center and towards the toe end and the heel end; wherein the nadir and the apex of the flex structure are located below the midplane.

Clause 11. The golf club head of clause 9, wherein the club head further defines a midplane that extends rearward the face center and towards the toe end and the heel end; wherein the nadir is located below the midplane, and the apex is located above the midplane.

Clause 12. The golf club head of clause 8, wherein the face reinforcement structure comprises: an inner perimeter surface located within the face reinforcement structure and extending perpendicular to the rear wall; and an outer perimeter surface located at a largest thickness of the face element and adjacent the inner perimeter surface.

Clause 13. The golf club head of clause 12, wherein the inner perimeter surface defines a rib span greater than or equal to 0.609 centimeters and less than or equal to 1.88 centimeters.

Clause 14. The golf club head of clause 8, wherein the face element comprises a variable thickness having: a first thickness measured from the face center to the rear wall in a direction perpendicular to the strike face; a second thickness measured from the strike face to an outer perimeter surface of the face reinforcing structure in a direction perpendicular to the strike face; a third thickness measured from the strike face to the rear wall devoid of the reinforcement element in a direction perpendicular to the strike face; and a fourth thickness measured from the strike face to the rear wall at the face perimeter in a direction perpendicular to the strike face; wherein the first thickness is a minimum thickness of the face element; and wherein the second thickness is a maximum thickness of the face element.

Clause 15. A golf club head comprising: a top rail; a sole opposite the top rail; a toe end; a heel end opposite the toe end; a rear portion connected to the sole and extending towards the top rail; a face element comprising: a strike surface; and a rear wall opposite the strike surface; a reinforcement structure formed integrally with the face element; a flex structure formed integrally with the face element and the rear portion; wherein: the face element defines a face center; the reinforcement structure comprises a circular looped rib that extends away from the rear wall and around the face center; the flex structure comprises a first end formed integrally with the face reinforcing structure, and a second end formed integrally with the rear portion; and the flex structure comprises a sinusoidal shape.

Clause 16. The golf club head of clause 15, wherein the flex structure comprises a nadir defining a lowermost portion of the flex structure, and an apex defining a topmost portion of the flex structure.

Clause 17. The golf club head of clause 16, wherein the flex structure defines a first radius of curvature at the nadir, and a second radius of curvature at the apex; and wherein the first radius of curvature and the second radius of curvature are equal.

Clause 18. The golf club head of clause 16, wherein the flex structure defines a first radius of curvature at the nadir, and a second radius of curvature at the apex; and wherein the first radius of curvature and the second radius of curvature are different.

Clause 19. The golf club head of clause 15, wherein the club head further defines a midplane that extends rearward the face center and towards the toe end and the heel end; wherein the nadir and the apex of the flex structure are located below the midplane.

Clause 20. The golf club head of clause 15, wherein the club head further defines a midplane that extends rearward the face center and towards the toe end and the heel end; wherein the nadir is located below the midplane and the apex is located above the midplane.

Various features and advantages of the disclosure are set forth in the following.

The invention claimed is:

1. A golf club head comprising:
- a top rail;
- a sole opposite the top rail;
- a toe end;
- a heel end opposite the toe end;
- a bottom wall opposite the sole;
- a rear portion connected to the sole and extending towards the top rail;
- a face element comprising:
  - a strike face; and
  - a rear wall opposite the strike face;
- a face reinforcement structure formed integrally with the face element, wherein:
  - the face reinforcement structure comprises an inner perimeter surface located within the face reinforcement structure and extending perpendicular to the rear wall, and an outer perimeter surface located at a thickest portion of the face element and adjacent the inner perimeter surface;
- a flex structure formed integrally with the face element and the rear portion, wherein:
  - the face element defines a face center located at a geometric center of the strike face;
  - the golf club head defines a midplane located at the face center and perpendicular to the strike face, the midplane extending rearward the face center and towards the toe end and the heel end;
  - the face reinforcement structure comprises a circular looped rib that extends away from the rear wall and around the face center;
  - the flex structure is below the midplane;
  - the rear wall, the rear portion, the toe end, the heel end, and the bottom wall together form a channel; and
  - the face element, the face reinforcement structure, and the flex structure are formed together as one integral body by a casting process.

2. The golf club head of claim 1, wherein the flex structure comprises a curved shape; and wherein the flex structure comprises a nadir defining a lowermost portion of the flex structure, and an apex defining a topmost portion of the flex structure.

3. The golf club head of claim 2, wherein both the nadir and the apex of the flex structure are located below the midplane.

4. The golf club head of claim 2, wherein the flex structure defines a first radius of curvature at the nadir, and a second radius of curvature at the apex; and wherein the first radius of curvature and the second radius of curvature are equal.

5. The golf club head of claim 2, wherein the flex structure defines a first radius of curvature at the nadir, and a second radius of curvature at the apex; and wherein the first radius of curvature and the second radius of curvature are different.

6. The golf club head of claim 1, wherein the face reinforcement structure comprises:
- an inner perimeter face located within the face reinforcement structure and extending perpendicular to the rear wall; and
- an outer perimeter face located at a largest thickness of the face element and adjacent the inner perimeter face.

7. The golf club head of claim 1, wherein the face element comprises a variable thickness having:
- a first thickness measured from the face center to the rear wall in a direction perpendicular to the strike face;
- a second thickness measured from the strike face to the outer perimeter surface of the face reinforcement structure in a direction perpendicular to the strike face;
- a third thickness measured from the strike face to the rear wall devoid of the face reinforcement structure in a direction perpendicular to the strike face; and
- a fourth thickness measured from the strike face to the rear wall at a perimeter of the face element in a direction perpendicular to the strike face;
- wherein the first thickness is a minimum thickness of the face element; and
- wherein the second thickness is a maximum thickness of the face element.

8. The golf club head of claim 1, wherein the flex structure extends across the channel such that the flex structure is spaced from and does not contact the bottom wall of the channel.

9. The golf club head of claim 1, wherein the flex structure defines a width between 0.1 inch to 0.4 inch.

10. A golf club head comprising:
- a top rail;
- a sole opposite the top rail;
- a toe end;
- a heel end opposite the toe end;
- a bottom wall opposite the sole;
- a rear portion connected to the sole and extending towards the top rail;
- a face element comprising:
  - a strike face; and
  - a rear wall opposite the strike face;
- a face reinforcement structure formed integrally with the face element, wherein:
  - the face reinforcement structure comprises an inner perimeter surface located within the face reinforcement structure and extending perpendicular to the rear wall, and an outer perimeter surface located at a thickest portion of the face element and adjacent the inner perimeter surface; and
  - the inner perimeter surface defines a rib span greater than or equal to 0.609 centimeters and less than or equal to 1.88 centimeter;
- a flex structure formed integrally with the face element and the rear portion, wherein:
  - the face element defines a face center located at a geometric center of the strike face;
  - the golf club head defines a midplane located at the face center and perpendicular to the strike face, the midplane extending rearward the face center and towards the toe end and the heel end;

the face reinforcement structure comprises a circular looped rib that extends away from the rear wall and around the face center;

the flex structure is below the midplane;

the rear wall, the rear portion, the toe end, the heel end, and the bottom wall together form a channel; and the face element, the face reinforcement structure, and the flex structure are formed together as one integral body by a casting process.

11. The golf club head of claim 10, wherein the flex structure comprises a curved shape; and wherein the flex structure comprises a nadir defining a lowermost portion of the flex structure, and an apex defining a topmost portion of the flex structure.

12. The golf club head of claim 11, wherein both the nadir and the apex of the flex structure are located below the midplane.

13. The golf club head of claim 11, wherein the flex structure defines a first radius of curvature at the nadir, and a second radius of curvature at the apex; and wherein the first radius of curvature and the second radius of curvature are equal.

14. The golf club head of claim 11, wherein the flex structure defines a first radius of curvature at the nadir, and a second radius of curvature at the apex; and wherein the first radius of curvature and the second radius of curvature are different.

15. The golf club head of claim 10, wherein the face element comprises a variable thickness having:

a first thickness measured from the face center to the rear wall in a direction perpendicular to the strike face;

a second thickness measured from the strike face to the outer perimeter surface of the face reinforcement structure in a direction perpendicular to the strike face;

a third thickness measured from the strike face to the rear wall devoid of the face reinforcement structure in a direction perpendicular to the strike face; and a fourth thickness measured from the strike face to the rear wall at a perimeter of the face element in a direction perpendicular to the strike face;

wherein the first thickness is a minimum thickness of the face element; and wherein the second thickness is a maximum thickness of the face element.

16. The golf club head of claim 10, wherein the flex structure extends across the channel such that the flex structure is spaced from and does not contact the bottom wall of the channel.

17. The golf club head of claim 10, wherein the inner perimeter surface further defines a rib span height greater than or equal to 0.30 centimeters.

18. The golf club head of claim 10, wherein the flex structure defines a width between 0.1 inch to 0.4 inch.

* * * * *